US008758520B2

(12) United States Patent
Monsrud et al.

(10) Patent No.: US 8,758,520 B2
(45) Date of Patent: Jun. 24, 2014

(54) ACID FORMULATIONS FOR USE IN A SYSTEM FOR WAREWASHING

(75) Inventors: Lee J. Monsrud, Inver Grove Heights, MN (US); Michael S. Rischmiller, Inver Grove Heights, MN (US); Daniel Osterberg, White Bear Township, MN (US); John Mansergh, Cottage Grove, MN (US)

(73) Assignee: Ecolab USA Inc., Saint Paul, MN (US)

( * ) Notice: Subject to any disclaimer, the term of this patent is extended or adjusted under 35 U.S.C. 154(b) by 103 days.

(21) Appl. No.: 13/474,771

(22) Filed: May 18, 2012

(65) Prior Publication Data

US 2012/0291815 A1 Nov. 22, 2012

Related U.S. Application Data

(60) Provisional application No. 61/519,315, filed on May 20, 2011, provisional application No. 61/569,885, filed on Dec. 13, 2011.

(51) Int. Cl.
*B08B 9/20* (2006.01)

(52) U.S. Cl.
USPC ..... 134/25.2; 134/25.1; 134/26; 134/27; 134/28; 134/29; 134/36; 134/42; 510/434; 510/480; 510/509

(58) Field of Classification Search
USPC ..... 134/25.1, 25.2, 26, 27, 28, 29, 36, 42; 510/434, 480, 509
See application file for complete search history.

(56) References Cited

U.S. PATENT DOCUMENTS

| | | | |
|---|---|---|---|
| 3,007,479 | A | 11/1961 | Jacobs et al. |
| 3,888,269 | A | 6/1975 | Bashark |
| 3,896,827 | A | 7/1975 | Robinson |
| 4,313,451 | A | 2/1982 | Vilen |
| 4,362,953 | A | 12/1982 | Bolin |
| 4,599,116 | A | 7/1986 | King et al. |
| 5,525,161 | A | 6/1996 | Milocco et al. |
| 5,704,380 | A | 1/1998 | Zelniker et al. |
| 5,725,002 | A | 3/1998 | Payzant |
| 5,783,540 | A | 7/1998 | Secemski et al. |
| 5,879,469 | A | 3/1999 | Avram |
| 5,972,870 | A | 10/1999 | Anderson |
| 6,098,639 | A | 8/2000 | Robinson |
| 6,218,349 | B1 | 4/2001 | Kravitz et al. |
| 7,415,983 | B2 | 8/2008 | Griese et al. |
| 8,092,613 | B2 | 1/2012 | Strothoff et al. |
| 2002/0065205 | A1 | 5/2002 | Maria Neplenbroek et al. |
| 2004/0173244 | A1 | 9/2004 | Strothoff et al. |
| 2004/0176264 | A1* | 9/2004 | Song et al. ..... 510/227 |
| 2004/0194810 | A1 | 10/2004 | Strothoff et al. |
| 2005/0137107 | A1* | 6/2005 | Griese et al. ..... 510/220 |
| 2010/0288309 | A1 | 11/2010 | Smith |
| 2011/0308553 | A1 | 12/2011 | Strothoff et al. |
| 2013/0146102 | A1* | 6/2013 | Monsrud et al. ..... 134/28 |

FOREIGN PATENT DOCUMENTS

| | | | |
|---|---|---|---|
| DE | 1 628 632 | | 8/1970 |
| DE | 23 43 145 | | 3/1975 |
| DE | 33 26 459 | A1 | 1/1985 |
| DE | 195 03 060 | A1 | 8/1996 |
| EP | 0 151 203 | A1 | 8/1985 |
| EP | 0 217 732 | A1 | 4/1987 |
| EP | 0 282 214 | A1 | 9/1988 |
| EP | 0 761 156 | A1 | 3/1997 |
| EP | 0 806 472 | A1 | 11/1997 |
| EP | 0 808 894 | A1 | 11/1997 |
| EP | 1 026 230 | A1 | 8/2000 |
| EP | 1 239 028 | A1 | 9/2002 |
| EP | 1 477 552 | A1 | 11/2004 |
| FR | 2-206-382 | | 11/1972 |
| GB | 798 274 | | 4/1959 |
| GB | 1027309 | | 4/1966 |
| JP | 62-225600 | A | 3/1986 |
| WO | WO 91/07904 | A1 | 6/1991 |
| WO | WO 92/18047 | A1 | 10/1992 |
| WO | WO 93/05696 | A1 | 4/1993 |
| WO | WO 95/14424 | A2 | 6/1995 |
| WO | WO 95/24148 | A2 | 9/1995 |
| WO | WO 98/30673 | A1 | 7/1998 |
| WO | WO 99/00474 | A1 | 1/1999 |
| WO | WO 00/43145 | A1 | 7/2000 |
| WO | WO 02/31095 | A1 | 4/2002 |
| WO | WO 02/100993 | A1 | 12/2002 |
| WO | WO 2004/052564 | A1 | 6/2004 |
| WO | WO 2004/101727 | A1 | 11/2004 |
| WO | WO2010147485 | A1 | 12/2010 |

OTHER PUBLICATIONS

Ecolab USA Inc. et al., PCT/IB2012/052523, Notification of Transmittal of the International Search Report and the Written Opinion of the International Searching Authority, or the Declaration, mail date Jan. 22, 2013.

* cited by examiner

*Primary Examiner* — Bibi Carrillo
(74) *Attorney, Agent, or Firm* — McKee, Voorhees & Sease, P.L.C.

(57) ABSTRACT

Methods of acidic warewashing are disclosed. The compositions can include other materials including surfactants and chelating agents, and are preferably phosphorous free. Methods of using the acidic compositions are also disclosed. Exemplary methods include using the acidic compositions together with other compositions, including alkaline compositions and rinse aids employed in an alternating alkaline/acid/alkaline manner. The methods also include acidic compositions that serve multiple roles.

12 Claims, No Drawings

ACID FORMULATIONS FOR USE IN A SYSTEM FOR WAREWASHING

CROSS-REFERENCE TO RELATED APPLICATIONS

This application claims priority and is related to both U.S. Provisional Application Ser. No. 61/519,315 filed on May 20, 2011 and entitled "Non-Phosphorus Acid Formulations for Use in an Alternating Alkali/Acid System for Warewashing," and U.S. Provisional Application Ser. No. 61/569,885 filed on Dec. 13, 2011 and entitled "Acid Formulations for use in a System for Warewashing." The entire contents of these patent applications are hereby expressly incorporated herein by reference including, without limitation, the specification, claims, and abstract, as well as any figures, tables, or drawings thereof.

FIELD OF THE INVENTION

The invention relates to detergent and cleaning compositions, particularly warewashing compositions comprising alternating acid/alkali systems. Applicants have surprisingly found that the type of acid used, particularly the specific anion from the acid makes a large impact on cleaning performance. In addition, Applicants have surprisingly found that select acids improve the cleaning performance and scale control of warewashing detergents. The invention relates to warewashing compositions, methods for manufacturing the same, and methods for using warewashing compositions in commercial and/or domestic dishwashing machines.

BACKGROUND OF THE INVENTION

In recent years there has been an ever increasing trend towards safer and sustainable detergent compositions. This has led to the development of alternative complexing agents, builders, threshold agents, corrosion inhibitors, and the like, which are used instead of predominantly phosphorus containing compounds. Phosphates can bind calcium and magnesium ions, provide alkalinity, act as threshold agents, and protect alkaline sensitive metals such as aluminum and aluminum containing alloys.

Alkaline detergents, particularly those intended for institutional and commercial use, generally contain phosphates, nitrilotriacetic acid (NTA) or ethylenediaminetetraacetic acid (EDTA) as a sequestering agent to sequester metal ions associated with hard water such as calcium, magnesium and iron and also to remove soils. In particular, NTA, EDTA or polyphosphates such as sodium tripolyphosphate and their salts are used in detergents because of their ability to solubilize preexisting inorganic salts and/or soils. When calcium, magnesium salts precipitate, the crystals may attach to the surface being cleaned and cause undesirable effects. For example, calcium carbonate precipitation on the surface of ware can negatively impact the aesthetic appearance of the ware, giving an unclean look. The ability of NTA, EDTA and polyphosphates to remove metal ions facilitates the detergency of the solution by preventing hardness precipitation, assisting in soil removal and/or preventing soil redeposition during the wash process.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can reduce the content of phosphorus-containing compounds such as phosphates, phosphonates, phosphites, and acrylic phosphinate polymers, as well as persistent aminocarboxylates such as NTA and EDTA.

In addition, environmentally-friendly detergent compositions still have to be effective and capable of removing difficult soils, especially those found in institutional settings such as restaurants. In particular, detergent compositions have to remove protein soils, starchy or sugary soils, fatty soils, and the like, where the soil may be burnt or baked on or otherwise thermally degraded.

There is a need for alternative, effective cleaning compositions.

Accordingly, it is an objective of the claimed invention to develop phosphorus-free acid compositions for use in an alternating alkali/acid system for warewashing.

A further object of the invention is to provide phosphorus-free acid products that outperform phosphoric acid, including for example urea sulfate and citric acid.

A further object of the invention is to provide improved methods for use in an alternating alkali/acid system for warewashing, including for example, providing excellent cleaning and rinsing results through the use of a single product for the acid shock treatment step and the final rinse step (rinse-aid).

A further object of the invention is improved residual acid in a rinse application of an alternating alkali/acid warewashing system.

BRIEF SUMMARY OF THE INVENTION

Surprisingly, it has been discovered that select acids improve the cleaning performance and scale control of warewashing detergents. These unexpected improvements in cleaning performance and scale control are particularly useful in non-phosphorus systems. Traditionally, it was thought that the pH of the acidic composition was important. The present disclosure shows that at a constant pH, there is a large difference in cleaning based upon the type of acid used in the cleaning composition.

Accordingly, in some aspects the present disclosure relates to warewashing compositions using selected acids. Preferred acids include urea sulfate, urea hydrochloride, sulfamic acid, methanesulfonic acid, phosphoric acid, citric acid, and combinations thereof. In some aspects, the acid is a non-phosphorous acid. In some aspects, the warewashing composition is phosphorous-free. In some aspects, the composition includes a chelating agent. Preferred chelating agents include citric acid, GLDA, MGDA, and glutamic acid. In some aspects, the composition includes a surfactant. In some aspects, the composition includes additional functional ingredients.

In some aspects, the present disclosure relates to a method of cleaning articles in a dish machine using the acidic warewashing compositions described above. In certain aspects, the methods of cleaning articles in a dish machine use a non-phosphate acid, preferably urea sulfate, citric acid, or a combination thereof in a phosphate-free detergent comprising an aforementioned acid, and a surfactant.

In some aspects, the method of cleaning articles in a dish machine uses the steps of supplying an acidic detergent composition, inserting the composition into a dispenser in a dish machine, forming a wash solution with the composition and water, contacting soil on an article in the dish machine with the wash solution, removing the soil, and rinsing the article.

In some aspects, the method of cleaning articles in a dish machine uses an acidic composition where the acidic composition is dispensed through a rinse arm, followed by a rinse aid step, where the rinse aid is also dispensed through the rinse arm. In this method, some of the acid from the acidic composition remains in the rinse arm and is dispensed simultaneously with the rinse aid in a manner that lowers the pH of the rinse aid.

In some aspects, the method of cleaning articles in a dish machine uses a single acidic composition for multiple steps, such as both an acidic detergent composition and an acidic rinse aid composition.

In some aspects, the method of cleaning articles in a dish machine includes cycling an alkaline detergent with the acidic detergent. In some aspects, the method includes a first alkaline step wherein an alkaline composition is brought into contact with an article during an alkaline step of the cleaning process. The alkaline composition includes one or more alkaline carriers. In an embodiment, the disclosed acidic cleaning composition is used in a three or more step process that includes at least a first alkaline step, a first acidic step, and a second alkaline step. The method may include additional alkaline and acidic steps. The method may also include pauses between steps as well as rinses. A particularly preferred method includes applying an alkaline composition, then an acidic composition and then a second alkaline composition to the article to be cleaned. Another method includes applying an acidic composition and then an alkaline composition to the article to be cleaned. The method can include a final rinse at the end with a rinse aid. And it may be beneficial to include pauses after the compositions are applied to allow the compositions to act on the food soils. This is especially true with the acidic composition, which benefits from a 5 to 15 second dwell time on the article. The method may be carried out using a variety of alkaline and acidic compositions. Finally, the method may be carried out in a variety of dish machines, include consumer and institutional dish machines.

These and other embodiments will be apparent to those of skill in the art and others in view of the following detailed description of some embodiments. It should be understood, however, that this summary, and the detailed description illustrate only some examples of various embodiments, and are not intended to be limiting to the claimed invention.

DETAILED DESCRIPTION OF THE INVENTION

The embodiments of this invention are not limited to particular acidic warewashing compositions and methods of use thereof, which can vary and are understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "cleaning" means to perform or aid in soil removal, bleaching, de-scaling, de-staining, microbial population reduction, rinsing, or combination thereof.

As used herein, the terms "phosphate-free" or "phosphorus-free" refers to a composition, mixture, or ingredients that do not contain phosphates or to which the same have not been added. Should other phosphate containing compounds be present through contamination of a composition, mixture, or ingredients, the amount of the same shall be less than 0.5 wt-%. In a preferred embodiment, the amount of the same is less than 0.1 wt-%, and in more preferred embodiment, the amount is less than 0.01 wt-%.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

As used herein, the term "ware" includes items such as for example eating and cooking utensils. As used herein, the term "warewashing" refers to washing, cleaning and/or rinsing ware.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods, systems and compositions of the present invention may comprise, consist essentially of, or consist of the component and ingredients of the present invention as well as other ingredients described herein. As used herein, "consisting essentially of" means that the methods, systems and compositions may include additional steps, components or ingredients, but only if the additional steps, components or ingredients do not materially alter the basic and novel characteristics of the claimed methods, systems and compositions.

It should also be noted that, as used in this specification and the appended claims, the term "configured" describes a system, apparatus, or other structure that is constructed or configured to perform a particular task or adopt a particular configuration. The term "configured" can be used interchangeably with other similar phrases such as arranged and configured, constructed and arranged, adapted and configured, adapted, constructed, manufactured and arranged, and the like.

Acidic Compositions

The invention generally relates to methods and compositions for cleaning articles in a dish machine using acidic compositions, namely detergents. In some embodiments, the acidic composition includes one or more acids. Preferred acids include urea sulfate, urea hydrochloride, sulfamic acid, methanesulfonic acid, phosphoric acid, citric acid, and mixtures thereof. In some embodiments, the acidic composition is phosphorous-free or phosphate-free. In some embodiments, the acidic composition can consist of or consist essentially of only the acid or the acid and water. An exemplary concentrate composition is show in Table 1.

TABLE 1

| | | | |
|---|---|---|---|
| Acid | 20-100 wt-% | 40-90 wt-% | 55-85 wt-% |
| Solidification Agent | as necessary | as necessary | as necessary |
| Water | balance | balance | balance |

In some embodiments the acidic composition includes the select acids and a surfactant. In some embodiments the acidic composition can consist of or consist essentially of only the acid and surfactant or the acid, surfactant and water. An exemplary concentrate composition with a surfactant is shown in Table 2.

TABLE 2

| | | | |
|---|---|---|---|
| Acid | 20-99 wt-% | 40-90 wt-% | 55-85 wt-% |
| Surfactant | 1-80 wt-% | 2-60 wt-% | 4-40 wt-% |
| Solidification Agent | as necessary | as necessary | as necessary |
| Water | balance | balance | balance |

In some embodiments the acidic composition includes the select acids and a chelating agent. Preferred chelating agents include citric acid, GLDA, MGDA, and glutamic acid. In some embodiments the acidic composition can consist of or consist essentially of only the acid and chelating agent or the acid, chelating agent and water. An exemplary concentrate composition with a chelating agent is shown in Table 3.

TABLE 3

| | | | |
|---|---|---|---|
| Acid | 20-99 wt-% | 40-90 wt-% | 55-85 wt-% |
| Chelating Agent | 1-50 wt-% | 4-30 wt-% | 10-20 wt-% |
| Solidification Agent | as necessary | as necessary | as necessary |
| Water | balance | balance | balance |

The composition may optionally include additional functional ingredients that enhance the effectiveness of the composition as a detergent or provide other functional aspects and features to the composition. Exemplary concentrate compositions with additional functional ingredients are shown in Table 4.

TABLE 4

| | | | |
|---|---|---|---|
| Acid | 20-99 wt-% | 40-90 wt-% | 55-85 wt-% |
| Surfactant | 0-80 wt-% | 2-60 wt-% | 4-40 wt-% |
| Chelating Agent | 0-50 wt-% | 4-30 wt-% | 10-20 wt-% |
| Sanitizer | 0-60% | 0.5-40% | 1-20% |
| Bleaching Agent | 0-60% | 0.5-40% | 1-20% |
| Anti-Corrosion Agent | 0-5% | 0.5-4% | 1-3% |
| Catalyst | 0.0001%-10% | 0.0002%-6% | 0.002%-0.1% |
| Thickener | 0-20% | 0.1-10% | 0.5-5% |
| Solidification Agent | as necessary | as necessary | as necessary |
| Water | balance | balance | balance |

Additional suitable acid compositions for cleaning soils in warewashing applications are disclosed in U.S. Pat. No. 7,415,983, which is incorporated herein by reference in its entirety.

Acid Source

The compositions of the present invention include an acid source. While the acid may be selected from a wide variety of acids, preferred acids include sulfuric acid derivatives, such as urea sulfate, sulfamic acid, methanesulfonic acid and others. Additional acids are particularly well suited for use in the acid compositions of the invention, including for example, urea hydrochloride, phosphoric acid, citric acid, gluconic acid, and mixtures thereof. In an embodiment of the invention the acid source is selected from the group consisting of urea sulfate, citric acid and combinations thereof. In an embodiment the acid source is phosphate free (e.g. does not include phosphoric acid).

In an aspect of the invention the acid may be a liquid or a solid at room temperature or a combination of liquid and solid. The acid preferably maintains an overall pH of the wash solution from 0 to 6, from 0 to 3, or from 0 to 2 during the acidic step of the wash process as measured by a pH probe based on a solution of the composition in a dish machine. The pH of the wash solution during the acidic step may be measured in a variety of dish machines, including for example, a 16 gallon dish machine, a machine that uses 0.3 gallons of rinse water in the acidic step, or other dish machines. The acid preferably maintains an overall pH of the wash solution from about 65 to 400 millivolts (mVs), from about 128 to 340 mVs, or from about 190 to 325 mVs.

Additional methods of measuring the pH and concentration of the product can be used. For example, titration can be used to measure the concentration of a product using a standard concentration of another reagent that chemically reacts with the product. This standard solution is referred to as the "titrant." Performing the titration also requires a method to determine when the reaction that occurs is complete or is brought to a certain degree of completion, which is referred to as the "end point" or more technically the equivalence point. One method that can be used is a chemical indicator which can indicate when the end point is reached. Another method to measure concentration is by using conductivity. Conductivity can be used to determine the ionic strength of a solution by measuring the ability of a solution to conduct an electric current. An instrument measures conductivity by placing two plates of conductive material with a known area a known distance apart in a sample. Then a voltage potential is applied and the resulting current is measured. Finally, the concentration can be determined using the pKa and pKb of the composition.

Typically it was thought that most acids would give similar performance, so long as they are capable of generating the appropriate pH in the use solution. Generally, these compositions have included acids of both organic and inorganic forms. Organic acids used in prior acidic solution have included hydroxyacetic (glycolic) acid, formic acid, acetic acid, propionic acid, butyric acid, valeric acid, caproic acid, gluconic acid, itaconic acid, trichloroacetic acid, urea hydrochloride, and benzoic acid, among others. Organic dicarboxylic acids such as oxalic acid, malonic acid, succinic acid, glutaric acid, maleic acid, fumaric acid, adipic acid, and terephthalic acid among others have been used. Combinations of these organic acids have also been used and were also intermixed or with other organic acids which allow adequate formation of typical acidic cleaning compositions. Inorganic acids or mineral acids have also been used such as phosphoric acid, sulfuric acid, sulfamic acid, methylsulfamic acid, hydrochloric acid, hydrobromic acid, hydrofluoric acid, and nitric acid among others. These acids have been used alone or in combination. Acid generators have also been used in these compositions to form a suitable acid, including for example generators such as potassium fluoride, sodium fluoride, lithium fluoride, ammonium fluoride, ammonium bifluoride, sodium silicofluoride, etc.

Examples of particularly suitable acids for use as the acid source according to the invention may include inorganic and organic acids. Exemplary inorganic acids include phosphoric, phosphonic, sulfuric, sulfamic, methylsulfamic, hydrochloric, hydrobromic, hydrofluoric, and nitric. Exemplary organic acids include hydroxyacetic (glycolic), citric, lactic, formic, acetic, propionic, butyric, valeric, caproic, gluconic, itaconic, trichloroacetic, urea hydrochloride, and benzoic. Organic dicarboxylic acids can also be used such as oxalic, maleic, fumaric, adipic, and terephthalic acid. Peracids such as peroxyacetic acid and peroxyoctanoic acid may also be used. Any combination of these acids may also be used.

In an embodiment of the invention, Applicants surprisingly discovered that urea sulfate gives superior cleaning performance in comparison to many traditional acids, such as phosphoric or nitric acid. Quite surprisingly, Applicants have found that this is so even when urea sulfate acidic compositions are compared to similar acidic compositions based upon very closely related acids such as methane sulfonic acid, sodium bisulfate, and sulfamic acid. The urea sulfate is particularly preferred as a result of its strong acid sufficiently lowering pH to attach soils (e.g. coffee, tea and starch) as well as minimizes neutralization of the alkaline wash tank. Additionally surprising, urea sulfate contributes to soil removal in subsequent alkaline wash steps. Without being limited to a particular theory of the invention, when the acid mixes with the alkaline detergent, it is no longer an acid, but is a salt, which results in the neutralized urea sulfate salt providing unexpected soil removal properties in an alkaline wash tank. This is unexpected as acids are not expected to have soil removal properties once neutralized (i.e. salts do not usually play a significant role in soil removal).

In one embodiment, the acid source preferably comprises from about 20 wt-% to about 100 wt-% of the total concentrate composition, from about 50 wt-% to about 99.5 wt-% of the total concentrate composition, more preferably from about 55 wt-% to about 97 wt-% of the total concentrate composition, from about 55 wt-% to about 85 wt-% of the total concentrate composition, and most preferably in the range of from about 90 wt-% to about 95 wt-% of the total concentrate composition.

Surfactant

The acidic composition can optionally include a surfactant. The surfactant or surfactant mixture can be selected from water soluble or water dispersible nonionic, semi-polar nonionic, anionic, cationic, amphoteric, or zwitterionic surface-active agents; or any combination thereof. A typical listing of the classes and species of useful surfactants appears in U.S. Pat. No. 3,664,961 issued May 23, 1972, which is incorporated herein by reference in its entirety.

In one embodiment, the surfactant preferably comprises from about 1 wt-% to about 80 wt-% of the total concentrate composition, from about 2 wt-% to about 60 wt-% of the total concentrate composition, and most preferably in the range of from about 4 wt-% to about 40 wt-% of the total concentrate composition.

When the acidic compositions are used as a rinse aid, preferred surfactants include D 097 (PEG-PPG), LD 097 (Polyoxyethylene polyoxypropylene), Pluronic 25-R8 (Polyoxypropylene polyoxyethylene block), Pluronic 10R5, Neodol 45-13 (Linear C14-15 alcohol 13 mole ethoxylate), Neodol 25-12 (Linear alcohol 12 mole ethoxylate), ABIL B 9950 (Tegopren-dimethicone propyl PG), Pluronic N-3 (Propoxy-Ethoxy N-3), Novel II 1012 GB-21 (alcohol ethoxylate C10-12, 21EO), Pluronic 25-R2 (Polyoxypropylene polyoxyethylene block), Plurafac LF-221 (Alkoxylated Alcohol), Genapol EP-2454 (Fatty alcohol alkoxylate), Plurafac LF-500 (Alcohol ethoxylate propoxylate), and Dehypon LS-36 (Ethoxylated Propoxylated Aliphatic Alcohol).

Nonionic Surfactants

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronico manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols can be used. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

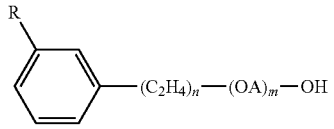

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)_m$ H wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]$, wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional useful conjugated polyoxyalkylene surface-active agents correspond to the formula: $P[(C_3H_6O)_n(C_2H_4O)_m H]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; R is a $C_5$-$C_31$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_x$ H, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$$R^{20}—(PO)_sN\text{-}(EO)_tH,$$

$$R_20\text{-}(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, v is 1 to 20 (e.g., 1, 2, 3, or 4 (preferably 2)), and w and z are independently 1-10, preferably 2-5.

These compounds are represented commercially by a line of products sold by

Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is a reference on the wide variety of nonionic compounds. A typical listing of nonionic classes, and species of these surfactants, is given in U.S. Pat. No. 3,929,678. Further examples are given in "Surface Active Agents and Detergents" (Vol. I and II by Schwartz, Perry and Berch). Each of these references is herein incorporated by reference in their entirety.

Semi-Polar Nonionic Surfactants

The semi-polar type of nonionic surface active agents is another class of useful nonionic surfactants. The semi-polar nonionic surfactants include the amine oxides, phosphine oxides, sulfoxides and their alkoxylated derivatives.

14. Amine oxides are tertiary amine oxides corresponding to the general formula:

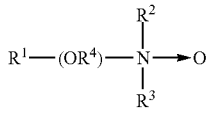

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis (2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

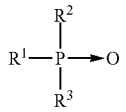

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^3$ are each alkyl moieties separately selected from alkyl or hydroxyalkyl groups containing 1 to 3 carbon atoms.

Examples of phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

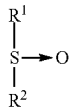

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Anionic Surfactants

Anionic surfactants are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants include the linear and branched primary and secondary alkyl sulfates, alkyl ethoxysulfates, fatty oleyl glycerol sulfates, alkyl phenol ethylene oxide ether sulfates, the $C_5$-$C_17$ acyl-N—($C_1$-$C_4$ alkyl) and —N—($C_1$-$C_2$hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants include the alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants include olefin sulfonates, such as long chain alkene sulfonates, long chain hydroxyalkane sulfonates or mixtures of alkenesulfonates and hydroxyalkanesulfonates. Also included are the alkyl sulfates, alkyl poly(ethyleneoxy)ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch), which is herein incorporated by reference in its entirety. A variety of such surfactants are also generally disclosed in U.S. Pat. No. 3,929,678 at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure $R_nX^+Y^-$—and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

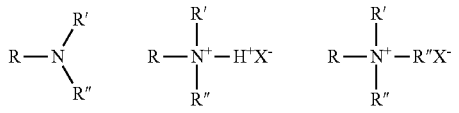

in which, R represents a long alkyl chain, R', R", and R'" may be either long alkyl chains or smaller alkyl or aryl groups or hydrogen and X represents an anion. The amine salts and quaternary ammonium compounds are preferred for their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989), which is herein incorporated by reference in its entirety. The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Useful cationic surfactants include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

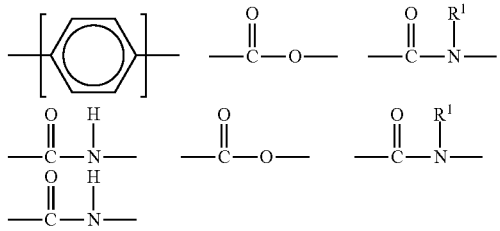

or an isomer or mixture of these structures, and which contains from 8 to 22 carbon atoms. The $R^1$ groups can additionally contain up to 12 ethoxy groups and m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group including, but not limited to:

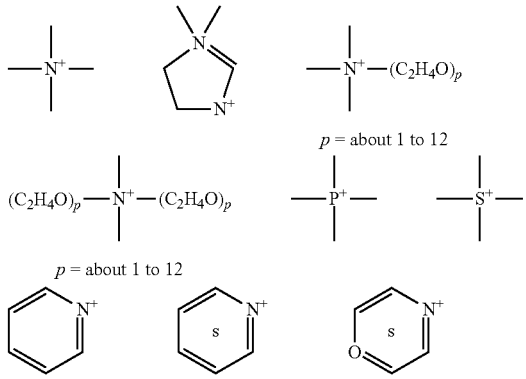

or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxyalkyl groups react to form a tertiary amine and an ether linkage with differing alkylating agents yielding different tertiary amines.

Long chain imidazole derivatives generally have the general formula:

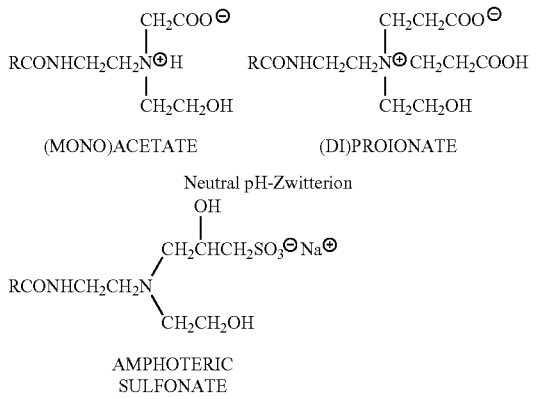

wherein R is an acyclic hydrophobic group containing from 8 to 18 carbon atoms and M is a cation to neutralize the charge of the anion, generally sodium. Commercially prominent imidazoline-derived amphoterics include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R is a $C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch), which is herein incorporated by reference in its entirety.

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

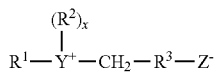

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-5-hexadecylsulfonio]-3-hydroxypentane-1-sulfate; 3-[P,P-diethyl-P-3,6,9-trioxatetracosanephosphonio]-2-hydroxypropane 1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

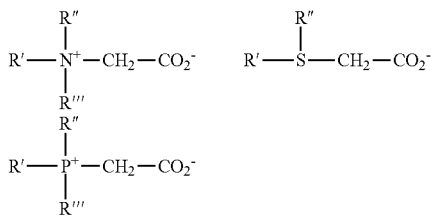

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch), which is herein incorporated by reference in its entirety.

Chelating Agents

The acidic composition can optionally include a chelating agent. Surprisingly, it has been found that using selected chelating agents is beneficial in combination with the acidic composition of the invention, particularly in a warewashing system that uses chemistry with alternating pH ranges. As certain soils are attacked by high pH compositions, over time, in an alternating pH system, the pH of the bulk wash tank gradually decreases making the wash solution in the wash tank less alkaline and therefore less effective at removing soils. In some embodiments, the present disclosure relates to using selected chelating agents to offset the gradual decrease in pH and boost cleaning performance. The result is that the cleaning benefits of an alternating pH system can be achieved without sacrificing cleaning performance over time. In addition to improving overall cleaning performance, including the chelating agent also improves specific soil removal efficacy, such as for example coffee and tea stain removal.

In one embodiment, the chelating agent preferably comprises from about 1 wt-% to about 50 wt-% of the total concentrate composition, from about 4 wt-% to about 30 wt-% of the total concentrate composition, and most preferably in the range of from about 10 wt-% to about 20 wt-% of the total concentrate composition.

In an embodiment, preferred chelating agents include citric acid, GLDA, MGDA, and glutamic acid. But, other chelating agents can be used as well, including phosphates, phosphonates, and amino-acetates. In an optional embodiment no phosphates or phosphonates are used for the chelating agent.

Exemplary phosphates include sodium orthophosphate, potassium orthophosphate, sodium pyrophosphate, potassium pyrophosphate, sodium tripolyphosphate (STPP), and sodium hexametaphosphate. Exemplary phosphonates include 1-hydroxyethane-1,1-diphosphonic acid, aminotrimethylene phosphonic acid, diethylenetriaminepenta(methylenephosphonic acid), 1-hydroxyethane-1,1-diphosphonic acid $CH._3C(OH)[PO(OH)_2]_2$, aminotri(methylenephosphonicacid) $N[CH_2PO(OH)_2]_3$, aminotri(methylenephosphonate), sodium salt 2-hydroxyethyliminobis(methylenephosphonic acid) $HOCH_2CH_2N[CH_2PO(OH)_2]_2$, diethylenetriaminepenta(-methylenephosphonic acid) $(HO)_2POCH_2N[CH_2CH_2N[CH_2PO(OH)_2]_2]_2$, diethylenetriaminepenta(methylenephosphonate), sodium salt $C_9H_{(28-x)}N_3Na_xO_{15}P_5$ (x=7), hexamethylenediamine(tetramethylenephosphonate), potassium salt $C_{10}H_{(28-x)}N_2K_xO_{12}P_4$ (x=6), bis(hexamethylene)triamine(pentamethylenephosphonic acid) $(HO_2)POCH_2N[(CH_2)_6N[CH_2PO(OH)_2]_2]_2$, and phosphorus acid $H_3PO_3$.

Exemplary amino-acetates include aminocarboxylic acids such as N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Additional Functional Ingredients

Other active ingredients may optionally be used to improve the effectiveness of the compositions, including the acidic detergents according to embodiments of the invention. Some non-limiting examples of such additional functional ingredients can include: anticorrosion agents, enzymes, foam inhibitors, thickeners, antiredeposition agents, anti-etch agents, antimicrobial agents, bleaching agents, catalysts, and other ingredients useful in imparting a desired characteristic or functionality in the composition. The following describes some examples of such ingredients.

In one embodiment, the additional functional ingredient (or combination of additional functional ingredients) preferably comprises from about 0 wt-% to about 60 wt-% of the total concentrate composition, from about 0.0001 wt-% to about 60 wt-% of the total concentrate composition, from about 0.1 wt-% to about 60 wt-% of the total concentrate composition, from about 0.5 wt-% to about 40 wt-% of the total concentrate composition, more preferably from about 1 wt-% to about 20 wt-% of the total concentrate composition.

Anticorrosion Agents

The composition may optionally include an anticorrosion agent. Anticorrosion agents help to prevent chemical attack, oxidation, discoloration, and pitting on dish machines and dishware surfaces. Preferred anticorrosion agents include copper sulfate, triazoles, triazines, sorbitan esters, gluconate, borates, phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine. When an anticorrosion agent is incorporated into the composition, it is preferably included in an amount of between about 0.05 wt-% and about 5 wt-%, between about 0.5 wt-% and about 4 wt-% and between about 1 wt-% and about 3 wt-%.

Wetting Agents

The compositions may optionally include a wetting agent which can raise the surface activity of the composition. The wetting agent may be selected from the list of surfactants described herein. Preferred wetting agents include Triton CF 100 available from Dow Chemical, Abil 8852 available from Goldschmidt, and SLF-18-45 available from BASF. The wetting agent is preferably present from about 0.1 wt-% to about 10 wt-%, more preferably from about 0.5 wt-% to 5 wt-%, and most preferably from about 1 wt-% to about 2 wt-%.

Enzymes

The composition may optionally include one or more enzymes, which can provide desirable activity for removal of protein-based, carbohydrate-based, or triglyceride-based soils from substrates such as flatware, cups and bowls, and pots and pans. Suitable enzymes can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

A valuable reference on enzymes is "Industrial Enzymes," Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980, which is incorporated herein by reference in its entirety.

Protease

A protease can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). Examples of proteolytic enzymes include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean®® or Optimase® by Solvay Enzymes; and the like. A mixture of such proteases can also be used. For example, Purafect® is a preferred alkaline protease (a subtilisin) having application in lower temperature cleaning programs, from about 30° C. to about 65° C. whereas, Esperase®® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30610, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Naturally, mixtures of different proteolytic enzymes may be used. While various specific enzymes have been described above, it is to be understood that any protease which can confer the desired proteolytic activity to the composition may be used. While the actual amounts of protease can be varied to provide the desired activity, the protease is preferably present from about 0.1 wt-% to about 3 wt-% more preferably from about 1 wt-% to about 3 wt-%, and most preferably about 2 wt-% of commercially available enzyme. Typical commercially available enzymes include about 5-10% of active enzyme protease.

Amylase

An amylase can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Suitable amylases include: I-amylases described in WO 95/26397, PCT/DK96/00056, and GB 1,296,839 to Novo; and stability enhanced amylases described in J. Biol. Chem., 260(11):6518-6521 (1985); WO 9510603 A, WO 9509909 A and WO 9402597 to Novo; references disclosed in WO 9402597; and WO 9418314 to Genencor International. A variant I-amylase is preferably at least 80% homologous, preferably having at least 80% sequence identity, with the amino acid sequences of the proteins of these references. Each of the references cited herein are incorporated by reference in its entirety.

Naturally, mixtures of different amylase enzymes can be used. While various specific enzymes have been described above, it is to be understood that any amylase which can confer the desired amylase activity to the composition can be used. While the actual amount of amylases can be varied to provide the desired activity, the amylase is preferably present from about 0.1 wt-% to about 3 wt-%, more preferably from about 1 wt-% to about 3 wt-%, and most preferably about 2 wt-% of commercially wt-% available enzyme. Typical commercially available enzymes include about 0.25 to about 5% of active amylase.

Cellulases

A suitable cellulase can be derived from a plant, an animal, or a microorganism. Preferably the cellulase is derived from a microorganism, such as a fungus or a bacterium. Preferred cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula* Solander. The cellulase can be purified or a component of an extract, and either wild type or variant (either chemical or recombinant).

Examples of cellulase enzymes that can be employed include those sold under the trade names Carezyme® or Celluzyme® by Novo, or Cellulase by Genencor; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo, each reference incorporated herein by reference in its entirety.

Naturally, mixtures of different cellulase enzymes can be used. While various specific enzymes have been described above, it is to be understood that any cellulase which can confer the desired cellulase activity to the composition can be used. While the actual amount of cellulose can be varied to provide the desired activity, the cellulose is preferably present from about 0.1 wt-% to about 3 wt-%, more preferably from about 1 wt-% to about 3 wt-%, and most preferably 2 wt-% of commercially available enzyme. Typical commercially available enzymes include about 5-10% active enzyme cellulase.

Lipases

A suitable lipase can be derived from a plant, an animal, or a microorganism. Preferably the lipase is derived from a microorganism, such as a fungus or a bacterium. Preferred lipases include those derived from a *Pseudomonas*, such as *Pseudomonas stutzeri ATCC* 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes include those sold under the trade names Lipase P "Amano" or "Amano-P" by Amano Pharmaceutical Co. Ltd., Nagoya, Japan or under the trade name Lipolase® by Novo, and the like. Other commercially available lipases include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas* gladioli or from *Humicola lanuginosa*.

A preferred lipase is sold under the trade name Lipolase® by Novo. Suitable lipases are described in patent documents, which are herein incorporated by reference in their entirety, including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

Naturally, mixtures of different lipase enzymes can be used. While various specific enzymes have been described above, it is to be understood that any lipase which can confer the desired lipase activity to the composition can be used. While the actual amount of lipase can be varied to provide the desired activity, the lipase is preferably present from about 0.1 wt-% to about 3 wt-% more preferably from about 1 wt-% to about 3 wt-%, and most preferably about 2 wt-% of commercially available enzyme. Typical commercially available enzymes include about 5-10% active enzyme lipase.

Additional Enzymes

Additional suitable enzymes include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Suitable peroxidases are disclosed in WO 89099813 A and WO 8909813 A to Novo. Peroxidase enzymes can be used in combination with oxygen sources, e.g., percarbonate, perborate, hydrogen peroxide, and the like. Additional enzymes are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Flora et al. Each of the references disclosing additional suitable enzymes are herein incorporated by reference in its entirety.

An additional enzyme, such as a cutinase or peroxidase can be derived from a plant, an animal, or a microorganism. Preferably the enzyme is derived from a microorganism. The enzyme can be purified or a component of an extract, and either wild type or variant (either chemical or recombinant).

Naturally, mixtures of different additional enzymes can be incorporated. While various specific enzymes have been described above, it is to be understood that any additional enzyme which can confer the desired enzyme activity to the composition can be used. While the actual amount of additional enzyme, such as cutinase or peroxidase, can be varied to provide the desired activity, the enzyme is preferably from about 1 wt-% to about 3 wt-%, and most preferably about 2 wt-% of commercially available enzyme. Typical commercially available enzymes include about 5-10% active enzyme.

Foam Inhibitors

A foam inhibitor may be optionally included for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein in its entirety. The composition may include from about 0.0001 wt-% to about 5 wt-% and more preferably from about 0.01 wt-% to about 3 wt-% of the foam inhibitor.

Thickeners

The composition may optionally include a thickener so that the composition is a viscous liquid, gel, or semisolid. The thickener may be organic or inorganic in nature. Thickeners can be divided into organic and inorganic thickeners. Of the organic thickeners there are (1) cellulosic thickeners and their derivatives, (2) natural gums, (3) acrylates, (4) starches, (5) stearates, and (6) fatty acid alcohols. Of the inorganic thickeners there are (7) clays, and (8) salts.

Some non-limiting examples of cellulosic thickeners include carboxymethyl hydroxyethylcellulose, cellulose, hydroxybutyl methylcellulose, hydroxyethylcellulose, hydroxypropylcellulose, hydroxypropyl methyl cellulose, methylcellulose, microcrystalline cellulose, sodium cellulose sulfate, and the like. Some non-limiting examples of natural gums include acacia, calcium carrageenan, guar, gelatin, guar gum, hydroxypropyl guar, karaya gum, kelp, locust bean gum, pectin, sodium carrageenan, tragacanth gum, xanthan gum, and the like. Some non-limiting examples of acrylates include potassium aluminum polyacrylate, sodium acrylate/vinyl alcohol copolymer, sodium polymethacrylate, and the like. Some non-limiting examples of starches include oat flour, potato starch, wheat flour, wheat starch, and the like. Some non-limiting examples of stearates include methoxy PEG-22/dodecyl glycol copolymer, PEG-2M, PEG-5M, and the like. Some non-limiting examples of fatty acid alcohols include caprylic alcohol, cetearyl alcohol, lauryl alcohol, oleyl alcohol, palm kernel alcohol, and the like. Some non-limiting examples of clays include bentonite, magnesium aluminum silicate, magnesium trisilicate, stearalkonium bentonite, tromethamine magnesium aluminum silicate, and the like. Some non-limiting examples of salts include calcium chloride, sodium chloride, sodium sulfate, ammonium chloride, and the like. Some non-limiting examples of thickeners that thicken the non-aqueous portions include waxes such as candelilla wax, carnauba wax, beeswax, and the like, oils, vegetable oils and animal oils, and the like.

The composition may contain one thickener or a mixture of two or more thickeners. The amount of thickener present in the composition depends on the desired viscosity of the composition. The composition preferably has a viscosity from about 100 to about 15,000 centipoise, from about 150 to about 10,000 centipoise, and from about 200 to about 5,000 centipoise as determined using a Brookfield DV-II+ rotational viscometer using spindle #21 @ 20 rpm @ 70° F.

Accordingly, to achieve the preferred viscosities, the thickener may be present in the composition in an amount from about 0 wt-% to about 20 wt-% of the total composition, from about 0.1 wt-% to about 10 wt-%, and from about 0.5 wt-% to about 5 wt-% of the total composition.

Antiredeposition Agents

The composition may also optionally include an antiredeposition agent capable of facilitating sustained suspension of soils in a cleaning solution and preventing the removed soils from being re-deposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like. The composition may include from about 0.5 wt-% to about 10 wt-% and more preferably from about 1 wt-% to about 5 wt-% of an antiredeposition agent.

Anti-Etch Agents

The composition may also optionally include an anti-etch agent capable of preventing etching in glass. Examples of suitable anti-etch agents include adding metal ions to the composition such as zinc, zinc chloride, zinc gluconate, aluminum, and beryllium. The composition preferably includes from about 0.1 wt-% to about 10 wt-%, more preferably from about 0.5 wt-% to about 7 wt-%, and most preferably from about 1 wt-% to about 5 wt-% of an anti-etch agent.

Antimicrobial Agent

The compositions may optionally include an antimicrobial agent or preservative. Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent, depending on chemical composition and concentration, may simply limit further proliferation of numbers of the microbe or may destroy all or a substantial proportion of the microbial population. As used herein, the terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population.

Common antimicrobial agents that may be used include phenolic antimicrobials such as pentachlorophenol, orthophenylphenol; halogen containing antibacterial agents that may be used include sodium trichloroisocyanurate, sodium dichloroisocyanurate (anhydrous or dihydrate), iodine-poly (vinylpyrrolidin-onen) complexes, bromine compounds such as 2-bromo-2-nitropropane-1,3-diol; quaternary antimicrobial agents such as benzalconium chloride, cetylpyridinium-chloride; amines and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition.

When an antimicrobial agent or preservative is incorporated into the composition, it is preferably included in an amount of between about 0.01 wt-% to about 5 wt-%, between about 0.01 wt-% to about 2 wt-%, and between about 0.1 wt-% to about 1.0 wt-%.

Bleaching Agent

The acidic composition may optionally include a bleaching agent. Bleaching agents include bleaching compounds capable of liberating an active halogen species, such as $Cl_2$, $Br_2$, —OCl— and/or —$OBr^-$, under conditions typically encountered during the cleansing process. Suitable bleaching agents include, for example, chlorine-containing compounds such as a chlorine, a hypochlorite, chloramine. Preferred halogen-releasing compounds include the alkali metal dichloroisocyanurates, chlorinated trisodium phosphate, the alkali metal hypochlorites, monochlorarrine and dichloramine, and the like. Encapsulated bleaching sources may also be used to enhance the stability of the bleaching source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like.

A cleaning composition may include a minor but effective amount of a bleaching agent, preferably from about 0.1 wt-% to about 10 wt-%, preferably from about 1 wt-% to about 6 wt-%.

Catalyst

The acidic compositions can optionally include a catalyst capable of reacting with another material in either the acidic composition, or another composition used in the dishwashing machine. For example, in some embodiments, the acidic composition can be used in a method of dishwashing where the method includes an acidic composition and an alkaline composition, and the acidic composition includes a catalyst and the alkaline composition includes something that the catalyst reacts with, such as an oxygen source, such that when the alkaline composition and the acidic composition interact inside of the dishwashing machine, they react. One reaction could be the production of oxygen gas in situ on and in soil located on an article to be cleaned inside of the dishmachine. The opposite could also be true, where the alkaline composition includes a catalyst and the acidic composition includes something that the catalyst reacts with such as a bleaching agent or oxygen source.

Exemplary catalysts include but are not limited to transition metal complexes, halogens, ethanolamines, carbonates and bicarbonates, iodide salts, hypochlorite salts, catalase enzymes, bisulfites, thiosulfate, and UV light. Exemplary transition metal complexes can be compositions that include a transition metal such as tin, lead, manganese, molybdenum, chromium, copper, iron, cobalt, and mixtures thereof. Exemplary halogens include fluorine, chlorine, bromine, and iodine.

Methods of Using the Acidic Compositions

The disclosure also relates to methods of using the acidic compositions.

Acidic Rinse Compositions

In some embodiments, the method includes dispensing the acidic composition through the rinse arm of the dishmachine and thereafter dispensing a rinse aid through the same rinse arm. In this method, a portion of the acidic composition remains in the rinse arm as residual product. This residual acidic composition is combined with the rinse aid when the rinse aid is dispensed through the same rinse arm. The combination of the rinse aid and the residual acidic composition lowers the pH of the rinse aid and makes it more effective at removing soils on articles in the final rinse.

In an embodiment, the residual acidic composition lowers the pH of the rinse aid composition for a period of time by at least about 0.5 pH units, preferably at least about 1 pH unit, or more preferably at least about 1.5 pH units or more in comparison to the rinse aid composition alone. In an aspect of the invention, the residual acidic composition lowers the pH of the rinse aid composition for a brief period of time, such as a second or a few seconds by at least about 0.5 pH units, preferably at least about 1 pH unit, or more preferably at least about 1.5 pH units or more in comparison to the rinse aid composition alone. In additional aspects of the invention the pH of the rinse aid composition is lowered for a longer period of time, such as from a few seconds to a minute, or from a few minutes or longer. The result is especially noticeable when an alkaline detergent is applied to the article in the dishmachine in between the acidic composition and the rinse aid. When an alkaline detergent is applied before the acidic rinse aid, it would be applied through a different arm of the dishmachine, such as the wash arm. This allows the acidic composition to remain in the rinse arm to be combined with the rinse aid. In the various embodiments, a variety of steps can be applied between the application of the acidic composition and rinse aid, as long as the acidic composition is the last component injected into the rinse arm before the final rinse (e.g. employing the rinse aid).

Dispensing the acidic composition through the rinse arm and thereafter spraying the final rinse water with the same rinse arm is the preferred way of lowering the pH in the final rinse, but it is understood that the effect can be accomplished in other ways. For example, the acidic composition could be pumped simultaneously with the final rinse water. The acidic composition could also be injected for the first one or two seconds or could be injected over the entire final rinse step. Likewise, the acidic composition, and not water, could be pumped into the rinse arm. Or a short delivery of acidic composition into the rinse arm could be completed just before the final rinse step.

In a further embodiment, the methods of in the invention may also include the step of spraying the acidic composition simultaneously for a period of time, including a very brief period of time (i.e. a few seconds) with a final rinse water application. According to the embodiment, even a very brief simultaneous spray of the acidic composition and the rinse water causes additional residual acid in the final rinse step to beneficially lower the pH.

In a still further embodiment, the methods of in the invention may also include the step of injecting the acidic composition for a period of time, including a very brief period of time (i.e. a second or more) before the final rinse water application. According to the embodiment, even a very brief injection of the acidic composition before the application of the final rinse water causes additional residual acid in the final rinse step to beneficially lower the pH.

Beneficially, use of the acidic composition as a rinse aid reduces the need for builders or chelating agents in the cleaning compositions as the acidic rinse step performs several builder functions. In a further aspect, superior results are achieved by include a small amount of chelating agent in the acid rinse step (e.g. within the acidic composition). In an aspect, a suitable chelant is used in combination with the acidic composition, including for example, citric acid, glutamic acid diacetic acid (GLDA), and methylglycinediacetic acid (MGDA).

According to an embodiment, applying a more acidic rinse aid after the alkaline step improves soil removal on articles, especially glassware and dark articles or ceramic surfaces. Surprisingly the residual acid improves the effectiveness of the final rinse, even when there is an alkaline wash step between the acidic step and the final rinse step. Without being limited to a particular theory of the invention, in an aspect the residual acid in the rinse system provides superior neutralizing and subsequent final rinsing of alkalinity off the dishes.

Beneficially, improving the soil removal allows a dishmachine to use less water and/or energy in the final rinse step. For example, a door dishmachine normally uses a water spray of 4 to 6 gallons per minute in the final rinse spray. Including the acidic composition in the final rinse allows the water spray in a door machine to be reduced to about 2 to 3 gallons per minute. Similarly, a door dishmachine typically sprays water in the final rinse for about 9 to 12 seconds. Including the acidic composition in the final rinse allows the duration of the final rinse to be decreased to about 4 to 6 seconds, or roughly half the regular time. In addition, as the final rinse water of a conventional institutional dishmachine is about 180° F., it is the largest energy consumption factor in the entire dishwashing process. Therefore, reducing the volume of water even more significantly reduces the amount of energy required to heat the rinse water.

According to an embodiment, in addition to reducing water and energy use, ending the dishmachine cycle with an acidic composition reduces water hardness scale and deposits on the machine as well as articles, especially glassware. In particular, the improved rinsing performance eliminates alkaline streaking on the ware, including for example glassware.

Acidic Compositions

In some embodiments, the method includes inserting the acidic composition into a dispenser in or associated with a dish machine, forming a solution with the composition and water, contacting a soil on an article in the dish machine with the solution, removing the soil, and rinsing the article.

In another embodiment, the method of the present invention involves using the steps of providing an acidic detergent composition comprising a surfactant and one or more acids described herein this description of the invention, including for example one or more acids selected from the group consisting of urea sulfate, citric acid, and combinations thereof, inserting the composition into a dispenser in or associated with a dish machine, forming a wash solution with the composition and water, contacting a soil on an article in the dish machine with the wash solution, removing the soil, and rinsing the article.

Beneficially, the methods of the invention employing an acidic composition and/or acidic rinse step within the alternating alkali/acid warewashing applications, such as described in U.S. Pat. No. 8,092,613, which is incorporated herein by reference in its entirety. This provides a number of benefits, including: lowering the pH and thus attacking soils (e.g. coffee, tea, and starch) that are susceptible to breakdown at low pH; providing a greater magnitude of pH shock within a system (e.g. change from high pH to low pH as opposed to only the acidic pH achieved); providing chelating power of the acid compositions to aid in the suspension and binding of soils and water-hardness related compounds; providing soil removal properties of the acid and the species formed when the acid is neutralized (i.e. combined with the alkalinity); and minimizing neutralization of the alkaline wash tank.

Surprisingly, it has been discovered that the acidic compositions of the invention when used in the methods disclosed herein are effective at removing all types of soils from articles in a dish machine, including hydrophobic soils. Quite surprisingly, it was found that when urea sulfate, citric acid or a combination of the two is used, cleaning performance substantially similar to that of phosphates (or phosphoric acid) is achieved. This is surprising, as it was thought that cleaning performance was optimized by the pH of the acidic cleaner, rather than the particular type of acid used.

In some embodiments, the acidic composition is a 2-in-1 composition wherein the composition is both the detergent and the rinse aid, and the method includes inserting the acidic composition into a dispenser in or associated with a dish machine, forming a wash solution with the composition and water, contacting a soil on an article in the dish machine with the wash solution, removing the soil, forming a rinse solution with the composition and water, and contacting the article in the dish machine with the rinse solution.

In some embodiments, the acidic composition is a 3-in-1 composition, wherein the composition is the detergent, sanitizer, and rinse aid, and the method includes inserting the acidic composition into a dispenser in or associated with a dish machine, forming a wash solution with the composition and water, contacting a soil on an article in the dish machine with the wash solution, removing the soil, forming a sanitizer solution with the composition and water, contacting the article in the dish machine with the sanitizer solution, forming a rinse solution with the composition and water, contacting the article with the rinse solution.

In some embodiments, the acidic composition (either a 2-in-1 or a 3-in-1 composition) generates more than one acidic use solution for cleaning. In an embodiment, the first and second acidic use solutions have the same concentrations of acid and surfactant. In an aspect, the concentration of acid and surfactant in a use solution may comprise from about 1000 to about 4000 ppm acid and from about 10 to about 50 ppm of surfactant. In an alternative embodiment, the first and second acidic use solutions have different concentrations of acid and surfactant.

The use of the acidic compositions (including a 2-in-1 or a 3-in-1 composition) to generate more than one acidic use solution for cleaning beneficially allows the use of a much smaller amount of surfactant, still needed to achieve optimum rinse aid performance. In a further benefit of this aspect of the invention, the acidic composition forms a single, versatile, dual purpose acid and rinse aid product that can be used over a wide range, is highly effective, non-corrosive, and non-wasteful. For example, the acidic composition allows the use of the acidic product at a high level in the acid step in order to achieve the excellent cleaning performance results required. Surprisingly and beneficially, the same single acid product can be used in the final rinse step at a much lower level, still providing excellent spotting, filming, and sheeting results.

In some embodiments, the method relates to removing soils from articles in a dish machine using at least a first alkaline step, a first acidic step, and a second alkaline step. In one embodiment, the method may include additional alkaline and acidic steps such as is described in U.S. Pat. No. 8,092,613, which is incorporated herein by reference in its entirety. In this embodiment, the additional alkaline and acidic steps preferably alternate to provide an alkaline-acidic-alkaline-acidic-alkaline pattern. While it is understood that the method may include as many alkaline and acidic steps as desired, the method preferably includes at least three steps, and not more than eight steps.

In another embodiment, the method may include pauses between the alkaline and acidic steps. For example, the method may proceed according to the following: first alkaline step, first pause, first acidic step, second pause, second alkaline step, third pause, and so on. During a pause, no further cleaning agent is applied to the dish and the existing cleaning agent is allowed to stand on the dish for a period of time.

In yet another embodiment, the method may include rinses. For example, the method may proceed according to the following: first alkaline step, first acidic step, second alkaline step, rinse. Alternatively, the method may proceed according to the following: first alkaline step, first pause, first acidic step, second pause, second alkaline step, third pause, rinse.

Finally, the method may include an optional prewash step before the first alkaline step.

In some embodiments, the method involves providing the individual components of the acidic composition separately and mixing the individual components in situ with water to form a desired solution such as a wash solution, a sanitizing solution, or a rinse solution.

In some embodiments, the method involves providing a series of cleaning compositions together in a package, wherein some of the cleaning compositions are acidic compositions, and some of the cleaning compositions are alkaline compositions. In this embodiment, a user would clean articles in a dish machine for a period of time using an alkaline composition, and then the user would switch to the acidic compositions.

The time for each step in the method may vary depending on the dish machine, for example if the dish machine is a consumer dish machine or an institutional dish machine. The time required for a cleaning step in consumer dish machines is typically about 10 minutes to about 60 minutes. The time required for the cleaning cycle in a U.S. or Asian institutional dish machine is typically about 45 seconds to about 2 minutes, depending on the type of machine. Each method step preferably lasts from about 2 seconds to about 30 minutes.

The temperature of the cleaning solutions in each step may also vary depending on the dish machine, for example if the dish machine is a consumer dish machine or an institutional dish machine. The temperature of the cleaning solution in a consumer dish machine is typically about 110° F. (43° C.) to about 150° F. (66° C.) with a rinse up to about 160° F. (71° C.). The temperature of the cleaning solution in a high temperature institutional dish machine in the U.S. is about typically about 150° F. (66° C.) to about 165° F. (74° C.) with a rinse from about 180° F. (82° C.) to about 195° F. (91° C.). The temperature in a low temperature institutional dish machine in the U.S. is typically about 120° F. (49° C.) to about 140° F. (60° C.). Low temperature dish machines usually include at least a thirty second rinse with a sanitizing solution. The temperature in a high temperature institutional dish machine in Asia is typically from about 131° F. (55° C.) to about 136° F. (58° C.) with a final rinse at 180° F. (82° C.).

The temperature of the cleaning solutions is preferably from about 95° F. (35° C.) to about 176° F. (80° C.).

When carrying out the method, the acidic composition may be inserted into a dispenser of a dish machine. The dispenser may be selected from a variety of different dispensers depending of the physical form of the composition. For example, a liquid composition may be dispensed using a pump, either peristaltic or bellows for example, syringe/plunger injection, gravity feed, siphon feed, aspirators, unit dose, for example using a water soluble packet such as polyvinyl alcohol, or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example using a water soluble packet such as polyvinyl alcohol or a foil pouch, evacuation from a pressurized chamber, or diffusion through a membrane or permeable surface. Finally, if the composition is a solid or powder, the composition may be dispensed using a spray, flood, auger, shaker, tablet-type dispenser, unit dose using a water soluble packet such as polyvinyl alcohol or foil pouch, or diffusion through a membrane or permeable surface. The dispenser may also be a dual dispenser in which one component, such as the acid component, is dispensed on one side and another component, such as the surfactant or antimicrobial agent, is dispensed on another side. These exemplary dispensers may be located in or associated with a variety of dish machines including under the counter dish machines, bar washers, door machines, conveyor machines, or flight machines. The dispenser may be located inside the dish machine, remote, or mounted outside of the dishwasher. A single dispenser may feed one or more dish machines.

Once the acidic composition is inserted into the dispenser, the wash cycle of the dish machine is started and a wash solution is formed. The wash solution comprises the acidic composition and water from the dish machine. The water may be any type of water including hard water, soft water, clean water, or dirty water. The most preferred wash solution is one that maintains the preferred pH ranges of about 0 to about 6, more preferably about 0 to about 4, and most preferably about 0 to about 3 as measured by a pH probe based on a solution of the composition in a dish machine that uses 0.3 gallons of rinse water in the acidic step. The same probe may be used to measure millivolts if the probe allows for both functions, simply by switching the probe from pH to millivolts. The dispenser or the dish machine may optionally include a pH probe to measure the pH of the wash solution throughout the wash cycle. The actual concentration or water to detergent ratio depends on the composition. Exemplary concentration ranges may include up to 3000 ppm, preferably 1 to 3000 ppm, more preferably 100 to 3000 ppm and most preferably 300 to 2000 ppm.

After the wash solution is formed, the wash solution contacts a soil on an article in the dish machine. Examples of soils include soils typically encountered with food such as proteinaceous soils, hydrophobic fatty soils, starchy and sugary soils associated with carbohydrates and simple sugars, soils from milk and dairy products, fruit and vegetable soils, and the like. Soils can also include minerals, from hard water for example, such as potassium, calcium, magnesium, and sodium. Articles that may be contacted include articles made of glass, plastic, aluminum, steel, copper, brass, silver, rubber, wood, ceramic, and the like. Articles include things typically found in a dish machine such as glasses, bowls, plates, cups, pots and pans, bakeware such as cookie sheets, cake pans, muffin pans etc., silverware such as forks, spoons, knives, cooking utensils such as wooden spoons, spatulas, rubber scrapers, utility knives, tongs, grilling utensils, serving utensils, etc. The wash solution may contact the soil in a number of ways including spraying, dipping, sump-pump solution, misting and fogging.

Once the wash solution has contacted the soil, the soil is removed from the article. The removal of the soil from the article is accomplished by the chemical reaction between the wash solution and the soil as well as the mechanical action of the wash solution on the article depending on how the wash solution is contacting the article.

Once the soil is removed, the articles are rinsed as part of the dish machine wash cycle.

The method can include more steps or fewer steps than laid out here. For example, the method can include additional steps normally associated with a dish machine wash cycle. The method can also optionally include an alkaline composition. For example, the method can optionally include alternating the acidic composition with an alkaline composition as described. The method may include fewer steps such as not having a rinse at the end.

Preferred Use Compositions

Ideal use-solution concentrations for an acidic detergent include about 1000 to 5000 ppm of an acid, or enough to achieve a pH of about 2 and from about 5 to 10 ppm of a surfactant. Ideal concentrations for a rinse aid include from about 100 to 500 ppm of an acid, or enough to achieve a pH of about 5 to 6, and about 20 to 80 ppm of a surfactant for sheeting, wetting, and drying. These numbers demonstrate that simply taking one formulation and using it in both a detergent and rinse aid application will result in overusing certain chemistry. Additionally, using high concentrations of acid in a final rinse step can lead to corrosion on certain articles. Using the selected acids and surfactants disclosed herein allows for using one composition for multiple reasons without overusing chemistry.

Accordingly, in some embodiments, the present disclosure relates to a composition that includes from about 100 to about 5000 ppm, about 1000 to about 4000 ppm, or about 2000 to about 3000 ppm of the acid and about 5 to about 80 ppm, about 10 to about 50 ppm, or about 20 to about 30 ppm of the surfactant. This composition provides acceptable concentrations of both the acid and the surfactant where neither material is overused and the composition achieves both the cleaning and sheeting action needed for the detergent and rinse aid compositions. While not wanting to be bound by theory, it is believed that the selected acids help remove water hardness, which improves sheeting in the rinse aid step and improves the appearance of the article, especially glassware and it also leaves a thin layer of acid on the surface, which helps lower the surface tension on the glass. It is believed that these contributions from the acid allow for lower surfactant concentrations in the 2-in-1 or 3-in-1 acidic compositions. In some embodiments, when the acidic composition is used as a 2-in-1 or 3-in-1 composition, the concentration of the composition can vary between steps. For example, the composition can be used at a first concentration in a detergent step, and a second concentration in a rinse aid step, or even a third concentration in a sanitizer step. In one embodiment, the composition is used at a higher concentration in a detergent step and a lower concentration in a rinse aid step.

Alkaline Composition

According to various embodiments the methods employ the alternating use of an alkaline composition with an acid composition. In various aspects the methods of use for the disclosed acidic cleaning compositions include using an alkaline composition. The alkaline composition includes one or more alkaline carriers. Some non-limiting examples of suitable alkaline carriers include the following: a hydroxide such as sodium hydroxide or potassium hydroxide; an alkali silicate; an ethanolamine such as triethanolamine, diethanolamine, and monoethanolamine; an alkali carbonate; and mixtures thereof. The alkaline carrier is preferably a hydroxide or a mixture of hydroxides, or an alkali carbonate. The alkaline carrier is preferably present in the diluted, ready to use, alkaline composition from about 125 ppm to about 5000 ppm, more preferably from about 250 ppm to about 3000 ppm and most preferably from about 500 ppm to about 2000 ppm. The alkaline composition preferably creates a diluted solution having a pH from about 7 to about 14, more preferably from about 9 to about 13, and most preferably from about 10 to about 12. The particular alkaline carrier selected is not as important as the resulting pH. Any alkaline carrier that achieves the desired pH may be used in the alkaline composition. The first alkaline cleaning step and the second alkaline cleaning step may use the same alkaline composition or different alkaline compositions.

The alkaline composition may optionally include additional ingredients. For example, the alkaline composition may include a water conditioning agent, an enzyme, an enzyme stabilizing system, a surfactant, a binding agent, an antimicrobial agent, a bleaching agent, a defoaming agent/foam inhibitor, an antiredeposition agent, a dye or odorant, a carrier, a hydrotrope and mixtures thereof.

Water Conditioning Agent

The alkaline composition can optionally include a water conditioning agent such as for example the chelating agents explained supra.

Surfactant

The alkaline composition can optionally include at least one surfactant or surfactant system, such as for example the surfactants explained supra.

Enzyme

The alkaline composition can optionally include an enzyme, such as for example the proteases, amylases, cellulases, and lipases described supra.

Enzyme Stabilizing System

The alkaline composition can optionally include an enzyme stabilizing system of a mixture of carbonate and bicarbonate. The enzyme stabilizing system can also include other ingredients to stabilize certain enzymes or to enhance or maintain the effect of the mixture of carbonate and bicarbonate.

The stabilizing systems may further include from 0 to about 10%, preferably from about 0.01 wt-% to about 6 wt-% of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions include salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other scavengers such as bisulfate, nitrate, chloride, sources of hydrogen peroxide such as sodium percarbonate tetrahydrate, sodium percarbonate monohydrate and sodium percarbonate, as well as phosphate, condensed phosphate, acetate, benzoate, citrate, formate, lactate, malate, tartrate, salicylate, etc., and mixtures thereof can be used.

Binding Agent

The alkaline composition may optionally include a binding agent to bind the detergent composition together to provide a solid detergent composition. The binding agent may be formed by mixing alkali metal carbonate, alkali metal bicarbonate, and water. The binding agent may also be urea or polyethylene glycol.

Bleaching Agent

The alkaline composition may optionally include a bleaching agent. Bleaching agents include bleaching compounds capable of liberating an active halogen species, such as $Cl_2$, $Br_2$, —OCl— and/or —$OBr^-$, under conditions typically encountered during the cleansing process. Suitable bleaching agents include, for example, chlorine-containing compounds such as chlorine, hypochlorite and/or chloramine. Preferred halogen-releasing compounds include the alkali metal dichloroisocyanurates, chlorinated trisodium phosphate, the alkali metal hypochlorites, monochloramine and dichloramine and the like. Encapsulated bleaching sources may also be used to enhance the stability of the bleaching source in the composition (see, for example, U.S. Pat. Nos. 4,618,914 and 4,830,773, the disclosures of which are incorporated by reference herein in their entirety). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The alkaline composition may include a minor but effective amount of a bleaching agent, preferably about 0.1 wt-% to about 10 wt-%, preferably from about 1 wt-% to about 6 wt-%.

Catalyst

The alkaline composition can optionally include a catalyst as explained supra.

Dye or Odorant

Various dyes, odorants including perfumes, and other aesthetic enhancing agents may optionally be included in the alkaline composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as CIS jasmine orjasmal, vanillin, and the like.

Hydrotrope

The alkaline composition may optionally include a hydrotrope, coupling agent, or solubilizer that aides in compositional stability, and aqueous formulation. Functionally speaking, the suitable couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-or-ter-polymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides.

Carrier

The alkaline composition may optionally include a carrier or solvent. The carrier may be water or other solvent such as an alcohol or polyol. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g. propylene glycol, ethylene glycol, glycerine, and 1,2-propanediol) can also be used.

Composition Formulation and Methods of Manufacturing

The composition may include liquid products, thickened liquid products, gelled liquid products, paste, granular and pelletized solid compositions powders, solid block compositions, cast solid block compositions, extruded solid block composition and others. Liquid compositions can typically be made by forming the ingredients in an aqueous liquid or aqueous liquid solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible aqueous, aqueous liquid or mixed aqueous organic system including a gelling agent at an appropriate concentration. Solid particulate materials can be made by merely blending the dry solid ingredients in appropriate ratios or agglomerating the materials in appropriate agglomeration systems. Pelletized materials can be manufactured by compressing the solid granular or agglomerated materials in appropriate pelletizing equipment to result in appropriately sized pelletized materials. Solid block and cast solid block materials can be made by introducing into a container either a pre-hardened block of material or a castable liquid that hardens into a solid block within a container. Preferred containers include disposable plastic containers or water soluble film containers. Other suitable packaging for the composition includes flexible bags, packets, shrink wrap, and water soluble film such as polyvinyl alcohol.

The compositions may be either a concentrate or a diluted solution. The concentrate refers to the composition that is diluted to form the use solution. The concentrate is preferably a solid. The diluted solution refers to a diluted form of the concentrate. It may be beneficial to form the composition as a concentrate and dilute it to a diluted solution on-site. The concentrate is often easier and less expensive to ship than the use solution. It may also be beneficial to provide a concentrate that is diluted in a dish machine to form the diluted solution during the cleaning process. For example, a composition may be formed as a solid and placed in the dish machine dispenser as a solid and sprayed with water during the cleaning cycle to form a diluted solution. In a preferred embodiment, the compositions applied to the dish during cleaning are diluted solutions and not concentrates.

The compositions may be provided in bulk or in unit dose. For example, the compositions may be provided in a large solid block that may be used for many cleaning cycles. Alternatively, the compositions may be provided in unit dose form wherein a new composition is provided for each new cleaning cycle.

The compositions may be packaged in a variety of materials including a water soluble film (e.g. polyvinyl alcohol), disposable plastic container, flexible bag, shrink wrap, and the like. Further, the compositions may be packaged in such a way as to allow for multiple forms of product in one package, for example, a liquid and a solid in one unit dose package.

The alkaline, acidic, and rinse compositions may be either provided or packaged separately or together. For example, the alkaline composition may be provided and packaged completely separate from the acidic composition. Alternatively, the alkaline, acidic, and rinse compositions may be provided together in one package. For example, the alkaline, acidic, and rinse compositions may be provided in a layered block or tablet wherein the first layer is the first alkaline composition, the second layer is the first acidic composition, the third layer is the second alkaline composition, and optionally, the fourth layer is the rinse composition. It is understood that this layered arrangement may be adjusted to provide for more alkaline and acidic steps as desired or to include additional rinses or no rinses. The individual layers preferably have different characteristics that allow them to dissolve at the appropriate time. For example, the individual layers may dissolve at different temperatures that correspond to different wash cycles; the layers may take a certain amount of time to dissolve so that they dissolve at the appropriate time during the wash cycle; or the layers may be divided by a physical barrier that allows them to dissolve at the appropriate time, such as a paraffin layer, a water soluble film, or a chemical coating.

In addition to providing the alkaline and acidic compositions in layers, the alkaline and acidic compositions may also be in separate domains. For example, the alkaline and acidic compositions may be in separate domains in a solid composition wherein each domain is dissolved by a separate spray when the particular composition is desired.

Dish Machines

The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines. In a preferred embodiment, the dish machine is made out of acid resistant material, especially when the portions of the dish machine that contact the acidic composition do not also contact the alkaline composition.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-1-1B, and the Jackson Tempstar.

The methods may be used in conjunction with any of the door machines described above. When the methods are used in a door machine, the door machine may need to be modified to accommodate the acidic step. The door machine may be modified in one of several ways. In one embodiment, the acidic composition may be applied to the dishes using the rinse spray arm of the door machine. In this embodiment, the rinse spray arm is connected to a reservoir for the acidic composition. The acidic composition may be applied using the original nozzles of the rinse arm. Alternatively, additional nozzles may be added to the rinse arm for the acidic composition. In another embodiment, an additional rinse arm may be added to the door machine for the acidic composition. In yet another embodiment, spray nozzles may be installed in the door machine for the acidic composition. In a preferred embodiment, the nozzles are installed inside the door machine in such a way as to provide full coverage to the dish rack.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

Example 1

The use of X-Streamclean soil removal methods were analyzed using different acids to show the comparison of phosphoric acid, nitric acid and urea sulfate on soil removal at 60 second cycles. Conventional wisdom holds that when using an acidic cleaner in warewashing the type of acid is not critical. It is believed that the final pH of the wash or rinse solution is the critical factor. Various non-phosphoric acids were evaluated to replace phosphoric acid and it was surprisingly discovered that the type of acid makes a significant difference on cleaning performance. This effect was not discovered until testing using non-phosphate alkali detergents were employed.

The comparison of soil removal performance of the three different acids was conducted using the 60 second cycle on the X-Streamclean Elux machine. The acids tested were: phosphoric acid—75% by weight; urea sulfate (Lime-A-Way formula containing 26% urea sulfate by weight; and nitric acid—20% by weight. Each acid was set up to provide a pH of 2 in the intermediate acid rinse cycle of the machine.

Soiling for soil removal efficacy included use of both tea and starch tiles using an automated dipping machine, tea stain or corn starch soil and ceramic tiles. The X-Streamclean Elux machine was set-up using 17 gpg water (e.g. hard water), a 60 second cycle (10 sec. alk, 5 sec pause, 5 sec. acid, 10 sec. pause, 15 sec. alk, 4 sec. pause, 11 sec. final rinse), and a Solid Power low phosphorus, non-phosphate alkali determent (1000 ppm). The average measured temperatures were as follows: Wash: 60° C., Rinse: 83° C. No rinse aids were added.

Initial pictures of the soiled tiles were obtained for Image Analysis. The dish machine was filled with 17 gpg hot water. The initial acid calibration was provided to obtain a pH of 2.0 in the acid rinse water. The pH of the acid rinse during the dishmachine cycle was measured and recorded. The machine was then completely drained and refilled with 17 gpg water. The detergent dispenser was turned on and charged up the wash tank with 1000 ppm of detergent. Two "warm-up" cycles were run and temperatures recorded during each of the 4 steps (wash 1, rinse 1, wash 2, rinse 2). One tea tile and one starch tile were placed in the rack in the machine. One cycle was run and temperatures recorded. The tea tile was removed after the one cycle. Two additional cycles were run with the starch tile in the rack before removing the starch tile from rack/machine. The pH of the acid rinse was measured during a normal cycle. Tiles were allowed to dry overnight and then photos were taken to analyze via Image Analysis to calculate the percentage of soil removed.

The results are shown in Table 5.

TABLE 5

| Test Conditions | Phosphoric Acid | Urea Sulfate | Nitric Acid | Nitric Higher Dose | Notes |
|---|---|---|---|---|---|
| 10 Sec. Manual pH | 1.86 | 1.82 | 1.92 | 1.56 | Average of 2 or 3 measurements |
| 5 Sec. auto pH | 2.10 | 1.94 | 2.10 | 1.83 | Average of 2 or 3 measurements |
| Normal cycle pH | 2.76 | 2.14 | 2.64 | 2.00 | Average of 2 or 3 measurements |
| Volume of Acid (mL) (before-after test) | | | | | Pump Injection Amount (mL) Measured before test and after test |
| Top | 0.6-0.7 | 1.8-2.2 | 2.0 | — | Phosphoric acid 75%, urea sulfate 26%, nitric acid 20% |
| Bottom | 0.6-0.5 | 1.8-1.7 | 1.7 | 1.8 | |
| Concentration of acid (%) | 0.05 | 0.04 | 0.03 | | Concentration of active acid in rinse water (1.25 L) |
| Pump Speed (%) | | | | | Percentage of max pump speed |
| Top | 24 | 77 | 64 | 100 | |
| Bottom | 24 | 98 | 96 | 100 | |
| W1 Temp (° C.) | 56 | 61 | 52 | 53 | Average over 3 performance cycles |
| R1 Temp (° C.) | 82 | 82 | 81 | 82 | Average over 3 performance cycles |
| W2 Temp (° C.) | 55 | 60 | 52 | 53 | Average over 3 performance cycles |
| R2 Temp (° C.) | 84 | 85 | 82 | 83 | Average over 3 performance cycles |
| % Soil Removal (Starch) | 79 | 79 | 63 | 67 | (Before-After)/(Before) * 100 |
| % Soil Removal (Tea) | 83 | 34 | 4 | 10 | (Before-After)/(Before) * 100 |

The results in Table 5 (as confirmed by Image Analysis) show that nitric acid performs relatively poorly on both tea and starch soils, whereas urea sulfate performs similarly to phosphoric acid on starch soil, but not as well as phosphoric acid on tea stain removal at an acidic pH of 2.0. Unexpectedly, the negative performance of nitric acid was not impacted by using higher concentrations (yielding a lower pH of 0.5 pH units).

Example 2

The use of X-Streamclean soil removal methods were analyzed using various acids on tea and starch tiles to test soil removal efficacy at 60 second versus 90 second cycles. The testing was completed to determine if alternative acids (from phosphoric acid) could be employed for the intermediate rinse of the X-Streamclean cycle. The acid urea sulfate (inline Lime-A-Way formulation) was tested as an alternative to phosphoric acid. The need for providing more uniform cleaning was also evaluated in using the urea sulfate as an alternative to phosphoric acid, due to starch plates leave a ring of heavy soil around the inside curve of the plate.

Ceramic tiles commonly used in the tea tile testing were coated with starch. The soiling procedure used an automated dipping machine to make the tea tiles. Starch tiles were prepared using 0.5 g of soil uniformly applied with a foam brush.

Digital Analysis was performed on all tiles to measure % soil removal for each test condition.

90 Second X-Streamclean cycle procedures. The X-Streamclean machine was filled with 17 gpg hot water. Acid rinse lines were primed with the specified acid and the Apex controller was set to dispense 1000 ppm Solid Power alkali detergent. Two tea tiles and 2 starch tiles were run through one standard 90 second cycle. Tiles were dried overnight and another set of pictures were taken to allow Image Analysis to calculate the percentage of soil removed.

60 Second X-Streamclean cycle procedures. The procedure for the 90 second cycle was adjusted to: shorten the initial wash cycle from 25 seconds to 10 seconds; shorten the final wash cycle from 30 seconds to 15 seconds.

60 Second Conventional Wash Cycle procedures (No Intermediate Rinse). The same procedures outlined for the 90 second X-Streamclean cycle were employed with the following adjustments: extend the initial wash cycle from 30 seconds to 45 seconds.

90 Second Conventional Wash Cycle procedures (No Intermediate Rinse The same procedures outlined for the 90 second X-Streamclean cycle was employed with the following adjustments: extend the initial wash cycle to 75 seconds.

The following cycle conditions were tested:

A. 90 Second X-Streamclean Cycle with 0.14% Phosphoric Acid treatment in 1.25 L intermediate rinse
B. 90 Second X-Streamclean Cycle with 0.18% Lime-A-Way (Urea Sulfate) treatment in 1.25 L intermediate rinse
C. 90 Second Conventional Wash Cycle—no intermediate rinse
D. 60 Second X-Streamclean cycle with 0.18% Lime-A-Way (Urea Sulfate) treatment in 1.25 L intermediate rinse
E. 60 Second Conventional Wash Cycle—no intermediate rinse The results are shown in Table 6.

TABLE 6

| | | Test A (Control, phosphoric acid) | Test B1 | Test B2 | Test B3 | Test C (Control) | Test D1 | Test D2 | Test E (Control) |
|---|---|---|---|---|---|---|---|---|---|
| % Soil Removal (Starch) | Tile 1 | 32.58 | 21.94 | 50.30 | 16.08 | 4.86 | 13.7 | 7.27 | 4.12 |
| | Tile 2 | 32.01 | 6.96 | 27.28 | 30.19 | 0 | 24 | 7.15 | 1.47 |
| % Soil Removal (Tea) | Tile 1 | 88.37 | 88.77 | 91.12 | 92.63 | 57.73 | 92.63 | 92.37 | 4.63 |
| | Tile 2 | 88.73 | 87.97 | 89.56 | 92.84 | 33 | 91.49 | 91.73 | 31.82 |

As shown in Table 6, the 90 Second X-Streamclean Cycle with Urea Sulfate in the intermediate rinse (Test B1) resulted in significantly more tea soil and starch soil removal when compared to the 90 second conventional wash cycle with no acid intermediate rinse (Test C, control).

As shown in Table 6, the 60 Second X-Streamclean wash cycle with Urea Sulfate intermediate rinse (Test B2) showed equal removal on the tea tiles as the equivalent 90 second X-Streamclean cycle (Test D1). The starch tiles, however, are inconclusive with soil removal ranging from 12% to 50% (Test B2 and D1).

As shown in Table 6, the starch tiles show a moderate difference between the X-Streamclean cycle with intermediate acid rinse (Test D2) compared to the conventional wash cycle (Test E), but the difference is not significant. It is uncertain whether the results with the starch tiles are from the testing conditions or from the variability of the new method being used. The tea tiles, however, show a large significant improvement when using the Urea Sulfate intermediate rinse treatment (Test D2) over the conventional wash cycle with no intermediate acid treatment (Test E).

As shown in Table 6, the 90 second X-Streamclean cycle with either phosphoric acid (Test A, Control) or Urea Sulfate (Test B3) in the 1.5 L intermediate rinse gave about 90% soil removal with no significant difference between acid treatments. This suggests urea sulfate is a comparable acid to phosphoric acid in regards to tea soil cleaning. The starch tiles were again a bit ambiguous with 3 of the 4 tiles having about the same soil removal but the fourth tile had 50% less removal. No solid conclusion can be drawn about using urea sulfate (Test B3) versus phosphoric acid (Test A, Control) in regards to starch soil.

The results show that urea sulfate is comparable to phosphoric acid in regards to tea soil cleaning. It is postulated that the reason that urea sulfate performed as well as phosphoric acid in this test, in comparison to Example 1, is that the alkali detergent used (Solid Power with tripolyphosphate) lessened the anion salt effect since phosphate was already present in the alkali/acid mixture. This is distinct from Example 1 where a phosphated alkali detergent was not employed.

Shortening the X-Streamclean cycle to 60 seconds by shortening the initial and final washes when using the urea sulfate intermediate acid treatment did not negatively impact tea soil removal on tea tiles (Test D). As with previous testing, it was again shown that the inclusion of the intermediate acid treatment, whether it is phosphoric acid or urea sulfate, is critical to cleaning performance and results in a dramatic improvement in cleaning performance of the tiles. In addition, the use of urea sulfate in the intermediate acid treatment in the 90 second X-Streamclean wash cycle (Test B) showed equal performance as the tiles run with phosphoric acid in the intermediate acid treatment step (Test A).

Form this series of experiments it is demonstrated that a 60 second X-Streamclean wash cycle with intermediate acid rinse (Test D) gives equal soil removal as the 90 second X-Streamclean wash cycle with intermediate acid rinse (Test B). We can also conclude that 0.18% Lime-A-Way (urea sulfate) treatment in a 1.25 L intermediate rinse (Tests B, D) can be used as an equal-performing alternative to 0.14% Phosphoric Acid in a 1.25 L intermediate rinse (Test A).

Example 3

The X-Streamclean soil removal methods were further analyzed using a 20 warm-up cycle, similar to Example 1 to test soil removal efficacy. The 0.12% Lime-A-Way (Urea Sulfate) formula, high dose 0.24% Lime-A-Way (Urea Sulfate) formula, and 0.13% phosphoric acid were compared using the 20 warm-up cycle as outlined in Table 7.

TABLE 7

| Test Conditions | Phosphoric Acid | Urea Sulfate | Urea Sulfate Higher Dose |
|---|---|---|---|
| Pump Speed (Top) (%) | 45 | 45 | 100 |
| Pump Speed (Bottom) (%) | 45 | 45 | 100 |
| Flow Rate (mL/cycle) | 1.8 | 1.8 | 3.7/3.2 (top/bottom) |
| Rinse pH (1) | 2.06 | 2.09 | 1.83 |
| Rinse pH (2) | 2.08 | 2.02 | 1.80 |
| Solid Power LP alkali detergent drops | 11 | 11 | 11 |
| Capsule Weight Before/ After (g) | 2312.88/2246.52 (Capsule Use: 66.36 g) | 2581.31/2520.74 (Capsule Use: 60.57 g) | 2471.26/2404.83 (Capsule Use: 66.4 g) |
| Acid Weight Before/ After (g) | 395.68/306.92 (Acid Use: 88.76 g) | 4222.19/4145.41 (Acid Use: 76.78 g) | 3508.00/3352.60 (Acid Use: 155.4 g) |
| % Soil Removal (Tea) | 52.30 | 12.91 | 22.79 |
| % Soil Removal (Tea) | 45.51 | 21.36 | 18.81 |
| % Soil Removal (Starch) | 77.93 | 70.06 | 78.20 |
| % Soil Removal (Starch) | 73.41 | 70.85 | 76.68 |
| Rinse pH | 2.09 | 2.11 | 1.84 |

The wash tank pH and temperatures (wash/rinse) at 0, 5, 10 and 20 cycles for each tested acid were as follows in Table 8.

TABLE 8

| Cycles | | Wash tank pH | Temp Wash | Temp Rinse |
|---|---|---|---|---|
| Urea Sulfate | 0 | 11.05 | 60 | 80 |
| | 5 | 10.72 | 59 | 82 |
| | 10 | 10.63 | 64 | 82 |
| | 20 | 10.42 | 67 | 82 |
| Urea Sulfate Higher Dose | 0 | 11.13 | 59 | 79 |
| | 5 | 10.71 | 60 | 80 |
| | 10 | 10.51 | 62 | 80 |
| | 20 | 10.33 | 66 | 81 |
| Phosphoric Acid | 0 | 11.04 | 64 | 87 |
| | 5 | 10.65 | 67 | 82 |
| | 10 | 10.33 | 67 | 82 |
| | 20 | 10.24 | 67 | 82 |

The results show that urea sulfate performs similarly to phosphoric acid on starch soil but not as good on tea stain removal. Consistent with Example 1, the alkali detergent did not contain phosphate.

Example 4

Scale prevention screening tests were also conducted. The X-Streamclean soil removal methods of Example 2 were further analyzed using Solid Power alkali detergent in 100 Cycle Test using 17 gpg water in an Electrolux WG65 dish-machine using 90 second cycles. Various non-phosphoric acids were evaluated to replace phosphoric acid as an acid rinse and it was surprisingly discovered that the type of acid makes a significant difference on scale control.

Table 9 shows the evaluation of the baseline conditions and the various acids evaluated.

TABLE 9

| | | Phos. Acid Rinse (1) | No Acid Rinse (XSC Cycle) (2) | No Acid Rinse (Normal Cycle) (3) | Urea Sulfate Acid Rinse (4) | MSA Acid Rinse (5) | Sodium Bisulfate Interm. Acid Rinse (6) | MSA Interm. Acid Rinse (7) | Urea Sulfate Interm. Acid Rinse (8) |
|---|---|---|---|---|---|---|---|---|---|
| Film Score | 1 | 2.00 | 5.00 | 4.50 | 5.00 | 5.00 | 4.50 | 5.00 | 3.00 |
| | 2 | 2.50 | 5.00 | 2.00 | 1.50 | 1.50 | 3.50 | 5.00 | 3.50 |
| | 3 | 2.00 | 5.00 | 3.00 | 1.50 | 4.00 | 5.00 | 5.00 | 4.00 |
| | 4 | 2.00 | 5.00 | 3.00 | 2.00 | 4.00 | 4.50 | 5.00 | 4.00 |
| | 5 | 1.50 | 5.00 | 2.00 | 1.50 | 3.50 | 4.00 | 5.00 | 3.50 |
| | 6 | 4.00 | 5.00 | 5.00 | 5.00 | 5.00 | 5.00 | 5.00 | 4.00 |
| | Plastic | 3 | 5.00 | 4.5 | 5 | 5 | 4.5 | 5.00 | |
| | 6 Glass Avg. | 2.33 | 5.00 | 3.25 | 2.75 | 4.17 | 4.42 | 5.00 | 3.67 |
| | 6 Glass Std. Dev. | 0.88 | 0 | 1.25 | 1.75 | 0.68 | 0.58 | 0 | 0.41 |
| | 4 Glass Avg. | 2.00 | 5.00 | 2.50 | 1.63 | 3.75 | 4.25 | 5.00 | 3.75 |
| | 4 Glass Std. Dev. | 0.41 | 0 | 0.58 | 0.25 | 0.29 | 0.65 | 0 | 0.29 |
| Light Box Mean | 1 | 15317.22 | 65535.00 | 65535.00 | 58432.18 | | | | 21739.29 |
| | 2 | 24297.88 | 65535.00 | 13567.00 | 11272.54 | | | | 17969.60 |
| | 3 | 14661.58 | 65535.00 | 15871.00 | 12126.09 | | | | 24046.22 |
| | 4 | 15819.85 | 65535.00 | 16063.00 | 15819.85 | | | | 15707.51 |
| | 5 | 12945.17 | 63930.63 | 13951.00 | 12945.17 | | | | 17332.09 |
| | 6 | 56138.38 | 65535.00 | 47295.00 | 56138.38 | | | | 27809.86 |
| | Plastic | | | | | | | | |
| | 6 Glass Avg. | 23197 | 65268 | 28714 | 27789 | | | | 20767 |
| | 6 Glass Std. Dev. | 16618 | 655 | 22241 | 22910 | | | | 4616 |

TABLE 9-continued

| | Phos. Acid Rinse (1) | No Acid Rinse (XSC Cycle) (2) | No Acid Rinse (Normal Cycle) (3) | Urea Sulfate Acid Rinse (4) | MSA Acid Rinse (5) | Sodium Bisulfate Interm. Acid Rinse (6) | MSA Interm. Acid Rinse (7) | Urea Sulfate Interm. Acid Rinse (8) |
|---|---|---|---|---|---|---|---|---|
| 4 Glass Avg. | 16931 | 65134 | 14863 | 13041 | | | | 18764 |
| 4 Glass Std. Dev. | 5051 | 802 | 1287 | 1974 | | | | 3648 |

As shown in Table 9 the use of a phosphoric acid as the intermediate rinse in the X-Stream Clean alkaline/acid/alkaline cleaning cycle demonstrated good results (Table 9(1)). The next test eliminated the phosphoric acid intermediate rinse, resulting in very filmy glasses due to the insufficient scale control (Table 9(2)). The elimination of the phosphoric acid intermediate rinse from a normal cycle using Solid Power alkali detergent, demonstrating there is a benefit to using the phosphoric acid in the intermediate rinse step of the alternating alkaline/acid/alkaline cleaning cycle (Table 9(3)).

After establishing the baseline comparison using phosphoric acid as the rinse, additional acids were evaluated to determine impact on their performance. The results show that urea sulfate is comparable to phosphoric acid in regards to scale prevention. The urea sulfate is also superior to both methane sulfonic acid (MSA) and sodium bisulfate in regard to scale prevention when either a phosphate detergent or a low phosphate detergent is used.

Interestingly, the use of phosphoric acid (in comparison to the tested acids) resulted in the greatest detergent neutralization (i.e. consumed the most detergent over the 100 cycles). The urea sulfate also demonstrated mild detergent consumption, which was considerably less than the phosphoric acid detergent consumption.

The results of Examples 1-4 obtained from the various acid-comparison tests employed constant pHs of the resulting acid solution. The pH of the resulting acid solution was held constant between the acid formulas tested to directly compare the acids. It was not expected that the acid type would make such a large difference in performance when tested at the same pH. Without being limited to a particular theory of the invention, the anion of the acid unexpectedly plays a role in the cleaning performance of the entire washing procedure. It is known that when an acid and a base mix to form salts, the anion from the acid typically combines with the cation from the base (or from the water) to form a salt. The formed salt species plays a role in the alternating alkali/acid system employed for the X-Streamclean soil removal methods disclosed herein. When phosphoric acid is used, it forms a phosphate salt which can have some soil removal and water conditioning effects. However, it was not expected that salts from other, non-phosphoric acids could have a similar effect since nitrates and sulfates are not known to have water conditioning properties.

When other acids (non-phosphoric acid) were used, differences in soil removal performance and scale prevention in hard water were observed in Examples 1-4, suggesting the specific anion from the acid plays a role. It was unexpectedly discovered that the salt formed after mixing the alkali and the acid together is important to cleaning performance. However, the acid anion effect is much less pronounced when a phosphated detergent is used (as was shown in Example 2), due to the phosphate species being present even before the alkali and acid mix to form a salt (i.e. phosphate species is already a good performing salt). The unexpected and surprising results demonstrated in Examples 1-4 show that in a completely non phosphorus system, the non-phosphoric acid had a significant effect.

Example 5

The effect of residual acid in the final rinse of an alternating alkali/acid warewashing system was evaluated to determine the impact on detergent carryover and performance. The rinsing and cleaning performance improvement obtained through the use of a residual acid in the final rinse was evaluated to determine whether a decrease in the amount of detergent (alkalinity) residue on ware (e.g. glassware) was achieved.

The effect of alkalinity carryover was evaluated using an alternating alkali/acid warewashing system employing an alkaline detergent used at 9 drops alkalinity (i.e. alkaline detergent) followed with an acid composition set to a total of 3.6 mL (i.e. acid rinse) which is the typical amount of acid composition used to achieve a pH of 2 during the warewashing application. The following cycles conditions were tested:

1. Standard alkaline detergent cycle without the acid step
2. Modified warewashing cycle, including alkaline detergent followed by the acid rinse delivering the entire 3.6 mL of acid composition during the first second of the 4 second acid step. The application of the acid composition during the first second of the 4 second step provides the modified cycle where the remaining 3 seconds provide fresh water to rinse out the residual acid from the rinse lines.
3. Standard warewashing cycle, including alkaline detergent followed by the acid rinse delivering the 3.6 mL of acid composition over the entire 4 seconds of the acid step.

Indicator P was then used on the glasses immediately after the warewashing cycle to check for alkalinity carryover on the ware. The darker the pink color observed on the ware is indicative of increased alkalinity remaining on the glassware. The same procedure was repeated using a 5 second final rinse rather than the standard 11 second final rinse. All other parameters were held constant.

The pH values were collected during the final rinse step of the standard warewashing cycle and modified warewashing cycle. No pH values were collected for the standard warewashing cycle without the acid step/composition. A full cycle was run and the final rinse duration was set to 2 seconds, 5 seconds, or 11 seconds. The rinse water was collected in a 4 L beaker and a pH value was collected. Two cycles were needed to collect a large enough sample for the 2 second rinse time experiment. One cycle provided an adequate sample for the 5 second and 11 second rinse time experiments.

Results—Acid Carryover Effect on Detergent/Alkalinity Carryover/Residue.

The glassware ran through the standard warewashing cycle without the acid step/composition showed the most and darkest pink coloring when Indicator P was applied (as evidenced by visual inspect and photographs). There was a decrease in color intensity of the pink coloring when Indicator P was applied to the glassware ran through the modified warewashing cycle; however, overall coverage of pink Indicator P was the same as with the standard warewashing cycle without the acid step/composition. The standard warewashing cycle with the acid step/composition showed both the least pink coverage and the lightest color intensity.

The same results were seen in the set of experiments run with the 11 second final rinse as and those run with 5 second final rinse, however the differences between the intensity of color across all 3 glasses was magnified in the 5 second rinse experiments. The standard warewashing cycle with the acid step/composition had a similar appearance in color intensity and coverage when run with a 5 second or 11 second rinse. However, bot the modified warewashing cycle and standard warewashing cycle without the acid step/composition had more coverage and higher color intensity in the 5 second rinse than in the 11 second rinse experiment. The tests demonstrate that the residual acid in the rinse arms substantially decreased the amount of detergent (alkalinity) residue on glassware. As a result, a clear embodiment of the invention is that the residual acid assists in rinsing off detergent residues.

Results—Acid Carryover Effect on Final Rinse pH.

The presence of acid in the intermediate acid step in the warewashing cycle has a significant effect on alkalinity carryover. The presence of acid decreased the amount of carryover, even when most of the acid was flushed from the final rinse water as seen in the modified warewashing cycle (described as condition 2 above). The Indicator P on these glasses had about the same overall coverage but was a much lighter color, indicating the amount of alkalinity on the glass was significantly less than that on the glass from the no-acid cycle (condition 1). A greater improvement was seen when running the regular warewashing cycle, which results in a higher amount of residual acid in the final rinse (condition 3). These glasses turned very light pink when Indicator P was applied and only parts of the glass turned color. These results were more pronounced when the final rinse was shorted to 5 seconds. Under these conditions, the standard warewashing cycle still showed minimal alkalinity carryover compared to the other cycle conditions. This indicates that while having acid present at any point in the cycle will decrease alkalinity carryover, having residual acid in the final rinse step can dramatically decrease the alkalinity carryover after the final rinse and allow you to shorten the final rinse time or decrease the water volume of the final rinse.

The pH measurements documented the presence of residual acid as shown in Table 10. The level of residual acid is highest at the beginning (within 2 seconds) and is gradually flushed from the rinse water, as is desired. The pH readings from the final rinse illustrate the presence of the residual acid in the final rinse step. Because there is only a small amount of acid remaining in the rinse line for the final rinse, collecting just the first 2 seconds of the rinse showed a greater difference between the different conditions. Collecting the final rinse water for 11 seconds leads to more similar numbers because of the large dilution of the residual acid.

TABLE 10

| Cycle Type | Final Rinse Time (s) | pH |
|---|---|---|
| 3 | 2 | 7.194 |
| 2 | 2 | 7.644 |
| 3 | 5 | 7.581 |
| 2 | 5 | 7.757 |
| 3 | 11 | 7.836 |
| 2 | 11 | 7.951 |

As demonstrated, the presence of the residual acid in the final rinse step (which was improved in condition 3) resulted in improved alkalinity carryover at regular rinse volumes and even decreased rinse volumes while maintaining excellent results under both conditions.

Example 6

The effect of residual acid evaluated in Example 5 was further used to determine the impact on water and energy reduction from a warewashing system. By providing residual acid in the rinse arms, water consumption was reduced by more than 50% while achieving the improved cleaning performance set forth in Example 5. Without residual acid, the glasses showed a big increase in alkalinity, but with residual acid there was no increase in alkaline residue while reducing the rinse water. This demonstrates that rinsing water can be reduced according to the methods of the invention. The rinse water is the largest energy contributor in a dishmachine due to the heating of the rinse water (e.g. about 180° F.); therefore there are huge energy savings by using less hot rinse water per cycle. As dishmachines are being required to operate with less and less water, the present invention helps to prevent an overall decrease in cleaning and rinsing performance.

Example 7

Additional commercial testing of the methods of the invention was employed using a Hobart Apex HT Dishmachine, which was, field retrofitted to employ the alternating alkali/acid warewashing methods. Water on-site was tested at 5 grain-per-gallon (85 ppm) hardness. The following chemistries were employed for the warewashing methods: (alkaline detergent) Apex Power with no builder, no chlorine; (acid composition) urea sulfate and citric acid; Apex Solid Rinse Aid (commercially available from Ecolab Inc., St. Paul, Minn.).

Results monitored are set forth below, all demonstrating significant improvements as a result of the acid process. The water hardness (e.g. scale) inside the dishmachine was significantly reduced. Similarly, the amounts of spotting and/or film on the treated glassware were significantly reduced. There was a slight improvement on both the starch and protein removal from plates and the stains removed from coffee cups. Overall, inclusion of the acid step resulted in improvements seen on most wares.

The improvement in glassware results with the residual acid present in the final rinse of the glassware was clearly demonstrated upon visual analysis of the ware. The white streaking is mostly from alkalinity and partially from other wash water solids that were not getting rinsed properly from the glasses when no residual acid was present.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. A method of cleaning articles in an institutional or a consumer dishmachine comprising:

providing a concentrated acidic composition, wherein the concentrated acidic composition comprises at least one acid selected from the group consisting of urea sulfate, urea hydrochloride, sulfamic acid, sulfuric acid, methylsulfamic acid, methanesulfonic acid, citric acid, gluconic acid and mixtures thereof; and a surfactant selected from the group consisting of an EO/PO block copolymer, a PO/EO reverse block copolymer, a linear alcohol ethoxylate, an alkoxylated alcohol, a fatty alcohol ethoxylate, a dimethicone surfactant, and mixtures thereof;

diluting the concentrated acidic composition to form a first acidic use solution having a first concentration of said acid and said surfactant;

applying the first acidic use solution to articles in need of cleaning as a detergent;

diluting the concentrated acidic composition to form a second acidic use solution having a second concentration of said acid and surfactant; and applying the second acidic use solution to the articles to be cleaned as a rinse aid in combination with a rinse aid composition having a pH, wherein the second acidic use solution lowers the pH of the rinse aid composition for a period of time by at least 1 pH unit compared to the rinse aid composition alone, wherein the method does not employ any phosphorus or phosphorus-containing compounds.

2. The method of claim 1, wherein the first acidic use solution and the second acidic use solution have the same concentrations of said acid and said surfactant.

3. The method of claim 1, wherein the first acidic use solution and the second acidic use solution have different concentrations of said acid and said surfactant.

4. The method of claim 1, further comprising applying to the articles at least one alkaline composition having a pH from about 7 to about 14 and comprising sodium hydroxide, potassium hydroxide, alkali carbonate, or mixtures thereof.

5. The method of claim 1, wherein the acid is selected from the group consisting of urea sulfate, urea hydrochloride, sulfamic acid, methanesulfonic acid, citric acid, gluconic acid and mixtures thereof and provides superior cleaning efficacy increased soil removal and reduced scaling in comparison to articles treated with a phosphoric acid composition.

6. The method of claim 1, wherein water required for the cleaning of articles in the dishmachine is reduced by about 50%.

7. The method of claim 2, wherein the first and second acidic use solutions comprise from about 1000 to about 4000 ppm acid and from about 10 to about 50 ppm of surfactant.

8. A method of cleaning articles in an institutional or a consumer dishmachine comprising:

spraying onto articles in need of cleaning an acidic composition using a rinse arm of the dishmachine, wherein the acidic composition comprises at least one acid selected from the group consisting of urea sulfate, urea hydrochloride, sulfamic acid, sulfuric acid, methylsulfamic acid, urea hydrochloride, methanesulfonic acid, citric acid, gluconic acid and mixtures thereof, and wherein at least a portion of the acidic composition is caused to remain in the rinse arm as residual acidic composition; and spraying onto the articles a mixture of a rinse aid composition having a pH and the residual acidic composition using the rinse arm of the dishmachine, wherein the residual acidic composition lowers the pH of the rinse aid composition for a period of time by at least 1 pH unit compared to the rinse aid composition alone.

9. The method of claim 8, further comprising a step of spraying the acidic composition simultaneously onto the articles for a period of time with a final rinse water application.

10. The method of claim 8, further comprising a step of injecting the acidic composition into the rinse arm for at least one second immediately before a final rinse step.

11. The method of claim 8, further comprising spraying an alkaline composition onto the articles through a wash arm of the dishmachine after the acidic composition but before the rinse aid composition and the residual acidic composition.

12. The method of claim 8, wherein water required for the cleaning of articles in the dishmachine is reduced by about 50%.

* * * * *

UNITED STATES PATENT AND TRADEMARK OFFICE

CERTIFICATE OF CORRECTION

PATENT NO. : 8,758,520 B2
APPLICATION NO. : 13/474771
DATED : June 24, 2014
INVENTOR(S) : Monsrud et al.

It is certified that error appears in the above-identified patent and that said Letters Patent is hereby corrected as shown below:

In the Claims:

Col. 50, Claim 5, Line 4:
Delete after provides "superior cleaning efficacy"

Col. 50, Claim 8, Line 20:
Delete after famic acid, "urea hydrochloride,"

Signed and Sealed this
Twenty-third Day of September, 2014

Michelle K. Lee

Michelle K. Lee
*Deputy Director of the United States Patent and Trademark Office*